US011059299B2

(12) United States Patent
Ishizawa et al.

(10) Patent No.: US 11,059,299 B2
(45) Date of Patent: Jul. 13, 2021

(54) INK REPLENISHING CONTAINER AND INK REPLENISHING SYSTEM

(71) Applicant: SEIKO EPSON CORPORATION, Tokyo (JP)

(72) Inventors: Taku Ishizawa, Matsumoto (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/750,816

(22) Filed: Jan. 23, 2020

(65) Prior Publication Data

US 2020/0238722 A1 Jul. 30, 2020

(30) Foreign Application Priority Data

Jan. 24, 2019 (JP) ..... JP2019-009974

(51) Int. Cl.
*B41J 2/175* (2006.01)

(52) U.S. Cl.
CPC ..... *B41J 2/17566* (2013.01); *B41J 2/17506* (2013.01); *B41J 2002/17573* (2013.01)

(58) Field of Classification Search
CPC ..... B41J 2/17566; B41J 2/17506; B41J 2002/17573
See application file for complete search history.

(56) References Cited

U.S. PATENT DOCUMENTS 6,017,118 A * 1/2000 Gasvoda ..... B41J 2/17513 347/86
6,322,205 B1 * 11/2001 Childers ..... B41J 2/17506 347/85
2016/0214392 A1 * 7/2016 Honoki ..... B41J 2/17566
2018/0207939 A1 7/2018 Ishizawa et al.

FOREIGN PATENT DOCUMENTS

JP 2018-118453 A 8/2018

* cited by examiner

*Primary Examiner* — Thinh H Nguyen
(74) *Attorney, Agent, or Firm* — Oliff PLC

(57) ABSTRACT

An ink replenishing container includes a first bottom surface that defines a portion of an ink storage portion in which an ink is stored, a first side wall that intersects the first bottom surface and defines a portion of the ink storage portion, an ink outlet that communicates with the ink storage portion, and a second side wall that is disposed outside the first side wall, and that is not in contact with the ink stored in the ink storage portion.

9 Claims, 16 Drawing Sheets

INK REPLENISHING CONTAINER AND INK REPLENISHING SYSTEM

The present application is based on, and claims priority from JP Application Serial Number 2019-009974, filed Jan. 24, 2019, the disclosure of which is hereby incorporated by reference herein in its entirety.

BACKGROUND

1. Technical Field

The present disclosure relates to an ink replenishing container and an ink replenishing system.

2. Related Art

Regarding an ink replenishing container for replenishing an ink to an ink tank provided in a printer or the like, for example, JP-A-2018-118453 discloses a structure in which a bottom of the container has a double structure by providing a cover on the bottom of the container.

In the container described in JP-A-2018-118453, the bottom portion has a double structure, but the side surface does not have a double structure. For this reason, when the user strongly presses the side of the container when replenishing the ink to the ink tank, the ink may vigorously eject from the ink outlet of the container and stain the surroundings. In addition, depending on the manner in which the container drops, the side surface of the container may be damaged, and the ink may leak out of the container.

SUMMARY

According to an aspect of the present disclosure, there is provided an ink replenishing container. The ink replenishing container is provided with a first bottom surface that defines a portion of an ink storage portion in which an ink is stored, a first side wall that intersects the first bottom surface and defines a portion of the ink storage portion, an ink outlet that communicates with the ink storage portion, and a second side wall that is disposed outside the first side wall, and that is not in contact with the ink stored in the ink storage portion.

DESCRIPTION OF EXEMPLARY EMBODIMENTS

A. First Embodiment

Figure 1:
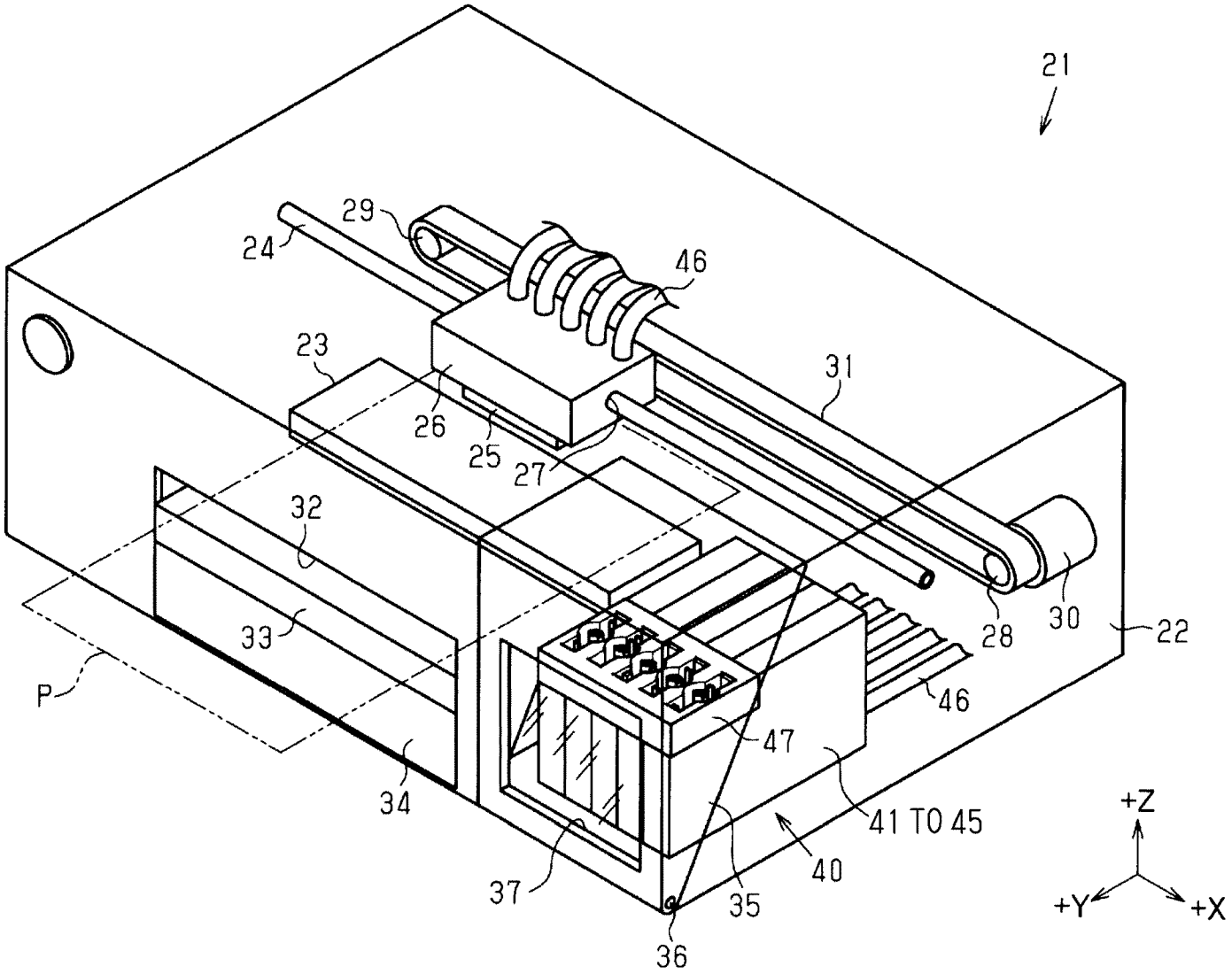
FIG. 1 is a perspective view schematically illustrating a schematic configuration of a recording apparatus in a see-through state.

FIG. 1 is a perspective view schematically illustrating a schematic configuration of a first embodiment of a recording apparatus 21 in a see-through state. FIG. 1 schematically illustrates a state where an inside of a housing 22 in the recording apparatus 21 is seen through. The recording apparatus 21 is an ink jet printer that records (prints) an image or the like on a medium by ejecting an ink onto the medium. FIG. 1 illustrates an X direction, a Y direction, and a Z direction orthogonal to each other. The X direction and the Y direction are directions parallel to a horizontal direction, and the Z direction is a direction parallel to a vertical direction. The X direction is also referred to as a left and right direction, the +X direction is a right direction, and the −X direction is a left direction. The Y direction is also referred to as a front and rear direction, the +Y direction is a front direction, and the −Y direction is a rear direction. The Z direction is also referred to as an up and down direction, the +Z direction is an upward direction, and the −Z direction is a downward direction.

The recording apparatus 21 is provided with a rectangular parallelepiped housing 22 having a longitudinal direction in the left and right direction. A support base 23 having the longitudinal direction in the left and right direction is provided in a lower portion near the rear in the housing 22 so that an upper surface thereof extends along a substantially horizontal direction. A paper P, which is an example of a medium, is transported toward the front in a transport direction while being supported on the upper surface of the support base 23. A guide shaft 24 extending along the left and right direction is installed above the support base 23 in the housing 22, and the guide shaft 24 supports a carriage 26 provided with a recording head 25 for ejecting the ink on a lower surface side. The carriage 26 is supported so as to freely reciprocate in the left and right direction with respect to the guide shaft 24 in a state where the guide shaft 24 is inserted into a support hole 27 penetrating in the left and right direction.

A drive pulley 28 and a driven pulley 29 are rotatably supported at positions in the housing 22 in the vicinity of both ends of the guide shaft 24. An output shaft of a carriage motor 30 is coupled to the drive pulley 28, and an endless timing belt 31, a portion of which is coupled to the carriage 26, is wound between the drive pulley 28 and the driven pulley 29. When the carriage 26 is reciprocated along the left and right direction, which is a scanning direction with respect to the paper P, while being guided by the guide shaft 24 via the timing belt 31 by driving the carriage motor 30, the ink is ejected onto the paper P from the recording head 25 on the lower surface side of the carriage 26 with respect to the paper P transported forward on the support base 23.

A rectangular discharge port 32 for discharging the paper P on which recording is performed by the ejection of ink from the recording head 25 when being transported on the support base 23 in the housing 22 to a front side is opened at a position on the front side of the support base 23 on a front surface side of the housing 22. The discharge port 32 is provided with a rectangular plate-shaped discharge tray 33 that can support the paper P discharged from the inside of the housing 22 so as to freely move forward and rearward in the discharge direction. In the discharge port 32, a paper feed cassette 34 that can store a plurality of sheets of the paper P used for recording in a stacked state is mounted below the discharge tray 33 so as to be inserted and removed in the front-rear direction.

An opening/closing door 35 whose front surface and upper surface are rectangular and whose right side surface is a right triangle is provided to freely open and close in the front and rear direction with a rotation shaft 36 provided at the lower end thereof as a rotation center along the left and right direction, at a position on a front surface of the housing 22, on an end portion side in the left and right direction from the discharge port 32, and on a right end portion side in the present embodiment. A window portion 37 made of a rectangular transparent member is formed on the front surface of the opening/closing door 35, and the user can visually recognize the inside of the housing 22, particularly the rear side of the front surface of the opening/closing door 35 with the opening/closing door 35 closed.

An ink supply unit 40 that supplies the ink to the recording head 25 is stored at a position that is the rear side of the opening/closing door 35, that is, a position close to the front surface and close to the end portion, and close to the right end portion in the present embodiment, in the housing 22 of the recording apparatus 21. The ink supply unit 40 is a structure including a plurality of ink tanks 41 to 45, five in the present embodiment, and that can be handled integrally. As will be described later, each of the ink tanks 41 to 45 can be replenished with ink.

Figure 2:
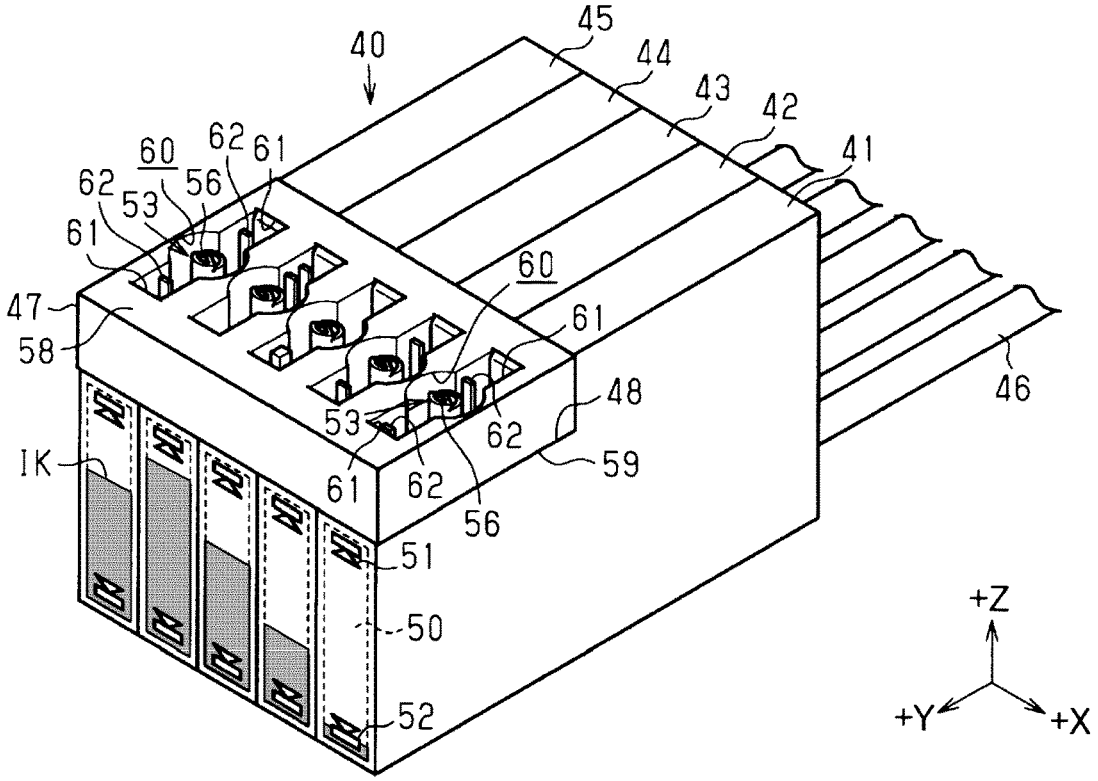
FIG. 2 is a perspective view of an ink supply unit.
Figure 3:
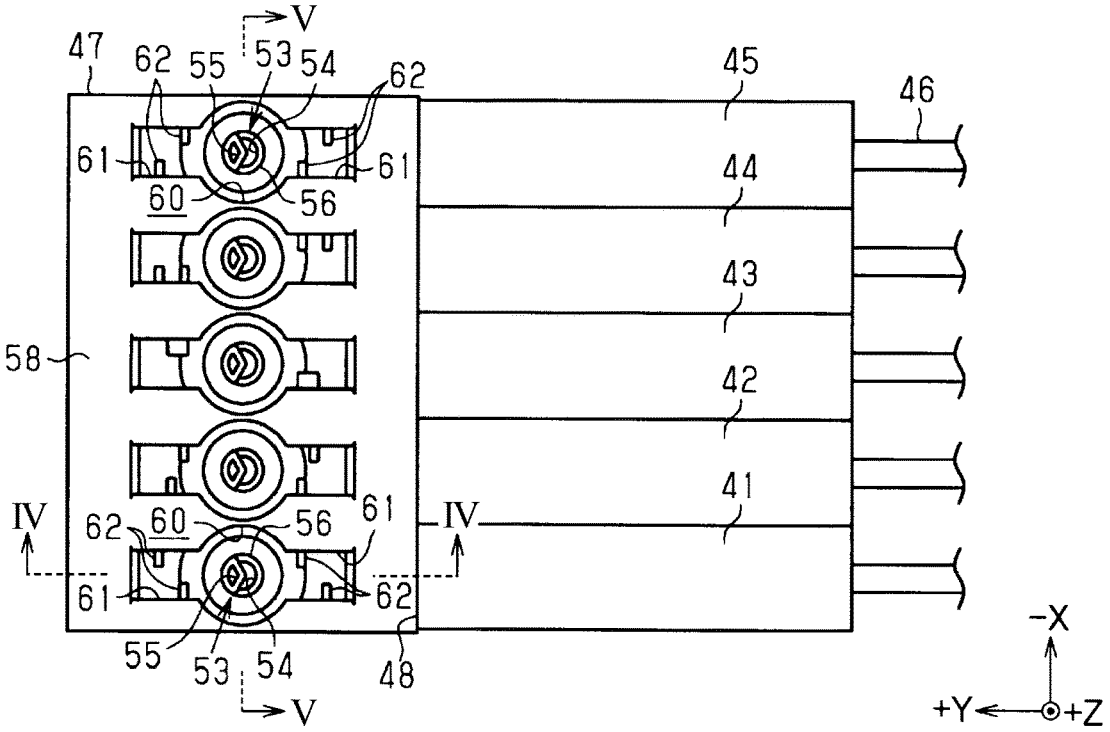
FIG. 3 is a plan view of the ink supply unit.

FIG. 2 is a perspective view illustrating the ink supply unit 40 provided in the housing 22 of the recording apparatus 21. FIG. 3 is a plan view of the ink supply unit 40 provided in the housing 22 of the recording apparatus 21. The ink supply unit 40 is configured to include five substantially tank-shaped ink tanks 41 to 45 that are long in the front and rear direction, five ink supply tubes 46 drawn from the rear surface side of each of the ink tanks 41 to 45, and a rectangular parallelepiped ink replenishing adapter 47 that can be assembled in a state where these ink tanks 41 to 45 are integrated. In a state where all the ink tanks 41 to 45 are arranged side by side with the thickness direction being the left and right direction, the ink replenishing adapter 47 is integrated with the ink tanks 41 to 45 by being assembled with a stepped portion 48 formed in a notch in the upper former half of all the ink tanks 41 to 45. As illustrated in FIG. 1, the ink supply tube 46 drawn from the ink tanks 41 to 45 is coupled to an ink flow path (not illustrated) formed in the carriage 26, and is coupled to the recording head 25 via the ink flow path. The ink replenishing adapter 47 may be a part that forms a portion of the housing 22 covering the ink tanks 41 to 45, or may be formed integrally with the ink tanks 41 to 45.

Figure 4:
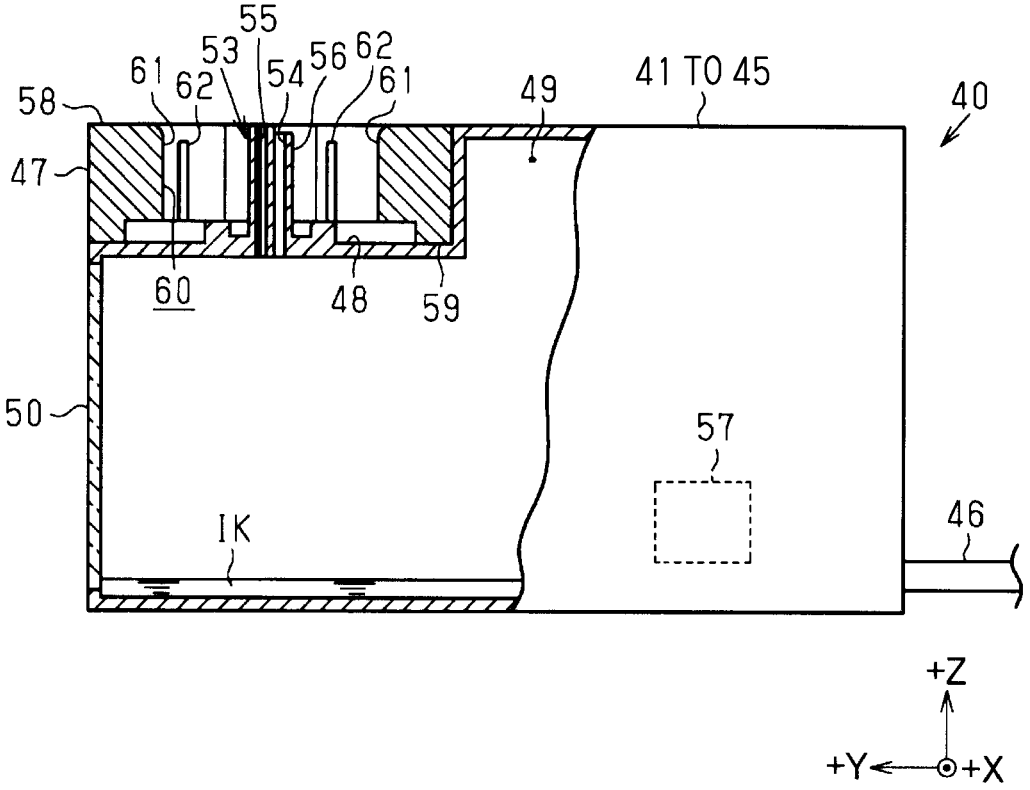
FIG. 4 is a partially broken sectional view taken along line IV-IV in FIG. 3.
Figure 5:
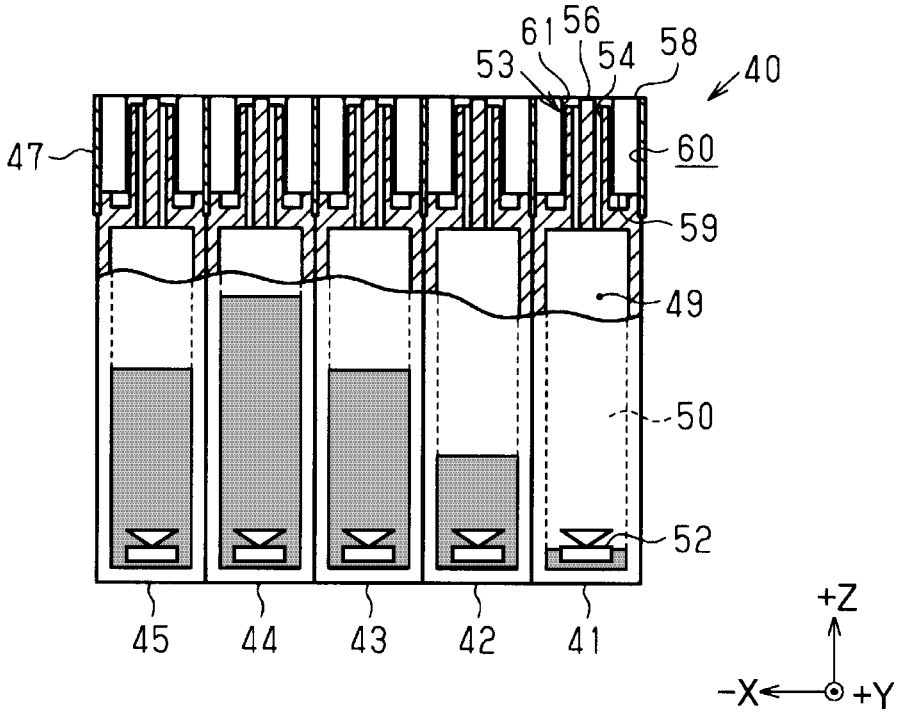
FIG. 5 is a partially broken sectional view taken along line V-V in FIG. 3.

FIG. 4 is a partially broken sectional view taken along line IV-IV in FIG. 3. FIG. 5 is a partially broken sectional view taken along line V-V in FIG. 3. Each of the ink tanks 41 to 45 includes an ink storage chamber 49 in which an ink IK can be stored. In the case of the present embodiment, a black ink is stored in the ink storage chamber 49 of the ink tank 41 located at the right end in a direction side by side. Inks other than black, for example, cyan, magenta, yellow, and the like are stored in the ink storage chambers 49 of the other ink tanks 42 to 45 arranged on the left side from the right end of the ink tank 41 in the direction side by side. In addition, a visual recognition portion 50 made of a transparent resin, and that enables visual recognition of the liquid level of the ink IK in the ink storage chamber 49 is provided in a front wall portion that is visually recognized through the window portion 37 on the front surface of the housing 22 in each of the ink tanks 41 to 45. An upper limit mark 51 indicating a measure of an upper limit and a lower limit mark 52 indicating a measure of a lower limit of the liquid level of the ink IK stored in the ink storage chamber 49 are written on the visual recognition portion 50. The measure indicated by the upper limit mark 51 is, for example, a measure of the amount of ink that can be injected without overflowing the ink from an ink inlet 53. The measure indicated by the lower limit mark 52 is, for example, a measure that prompts the user to replenish the ink.

As illustrated in FIG. 4, the ink inlet 53 that allows the ink to flow into the ink storage chamber 49 from the outside is provided above the horizontal portion of the stepped portion 48 in each of the ink tanks 41 to 45. The ink inlet 53 is configured to include a needle 56 that has flow paths 54 and 55 communicating the inside with the outside of the ink storage chamber 49, and that extends vertically upward. The flow paths 54 and 55 of the needle 56 are formed of two flow paths 54 and 55 in which each of the tip end openings is arranged side by side in a radial direction with the needle 56 as a center. The flow path 54 on the rear side in the present embodiment, which is one of the flow path 54 among the two flow paths 54 and 55, is formed so that the height of the tip end opening is lower and the cross-sectional area of the flow path is larger than these of the flow path 55 on the front side in the present embodiment, which is the other of the flow path 55. A remaining amount sensor 57 for detecting the remaining amount of ink IK in the ink storage chamber 49 is provided at the lower portion rearward in the ink storage chamber 49. The remaining amount sensor 57 may not be provided.

As illustrated in FIGS. 2 to 5, in the ink replenishing adapter 47, an upper surface 58 thereof is a horizontal surface along a direction intersecting, preferably perpendicular to, a direction in which the needle 56 extends, and a through-hole 60 penetrating vertically to a lower surface 59 is formed on the upper surface 58 as an ink inlet forming portion. The through-hole 60 includes a circular hole-shaped ink inlet 53 in which the needle 56 is disposed in the center and a pair of front and rear rectangular hole portions coupled to the front and rear of the ink inlet 53, and the lower opening thereof is closed by a horizontal portion of the stepped portion 48 projecting with the needle 56 facing upward in the ink tanks 41 to 45.

In the through-hole 60, in a region outside the ink inlet 53 in the radial direction with the ink inlet 53 as a center, a pair of front and rear recessed portions 61 opening upward in the direction where the needle 56 extends are formed to be recessed with vertical downward as the depth direction so as to be point-symmetric about the ink inlet 53 by the pair of front and rear rectangular hole portions that close the opening on the loser side. That is, the plurality of recessed portions 61 that are point-symmetric about the ink inlet 53, and that are two pairs on the front and rear in the present embodiment, are formed in the region outside the ink inlet 53 including the needle 56, in the ink replenishing adapter 47 integrated with the ink tanks 41 to 45. In this case, the tip end of the needle 56 disposed at the center of the circular hole-shaped ink inlet 53 is located closer to the ink storage chamber 49 side than the upper surface 58 of the ink replenishing adapter 47 that is the opening edge of the through-hole 60 including the ink inlet 53 and the recessed portion 61. That is, the upper surface 58 of the ink replenishing adapter 47 extends in a direction intersecting with the direction where the needle 56 extends at a position outside the tip end of the needle 56 in the direction where the needle 56 extends. On the other hand, the lower surface 59 of the ink replenishing adapter 47 functions as a tank engagement portion that collectively engages the plurality of ink tanks 41 to 45 arranged side by side in the left and right direction from above.

A peripheral portion of the upper opening edge of each through-hole 60 is colored in a specific color of the upper surface 58 of the ink replenishing adapter 47. Specifically, the peripheral portion is colored in the same color as the color of the ink stored in the ink storage chamber 49 of the ink tanks 41 to 45 through which the ink flows through the ink inlet 53 of the through-hole 60. In this respect, the peripheral portion of the upper opening edge of each through-hole 60 in the ink replenishing adapter 47 functions as a first portion that indicates information related to the ink stored in the ink tanks 41 to 45 communicating with the ink inlet 53 of the through-hole 60 and the ink storage chamber 49 to the outside. Incidentally, the peripheral portion of an upper opening of the through-hole 60 where the ink inlet 53 communicating with the ink storage chamber 49 of the ink tank 41 storing the black ink is disposed is colored black.

A first uneven portion 62 having a characteristic uneven shape in the horizontal direction is provided so as to extend along the depth direction of the recessed portion 61, in other words, the direction of the central axis of the ink inlet 53 at a position that is on a bottom surface side from the upper opening edge of the recessed portion 61, that is, on the horizontal portion side of the stepped portion 48, on the inner surface of the recessed portion 61, specifically, on the inner surface along the up and down direction. The first uneven portion 62 is also referred to as a first key structure portion. As illustrated in FIGS. 2 and 3, the first uneven portions 62 are provided for each of a plurality of the ink inlets 53 of the ink tanks 41 to 45, which are five in the present embodiment. Therefore, in the ink replenishing adapter 47, a first uneven portion 62 different from the first uneven portion 62 provided on the inner surface of the recessed portion 61 of the other through-hole 60 is formed for each of the through-holes 60, in the rectangular recessed portion 61 in each of the through-holes 60 formed at a position corresponding to each of the ink tanks 41 to 45 in the up and down direction. That is, these first uneven portions 62 function as identification portions that enable identification of an ink replenishing container 63 having an ink outlet 65 coupled to the ink inlet 53 in the through-hole 60 in which the first uneven portion 62 is formed. The "position on the bottom surface side from the opening edge on the upper side of the recessed portion 61" means that the position may be a position slightly retracted toward the bottom surface side from the opening edge.

Figure 6:
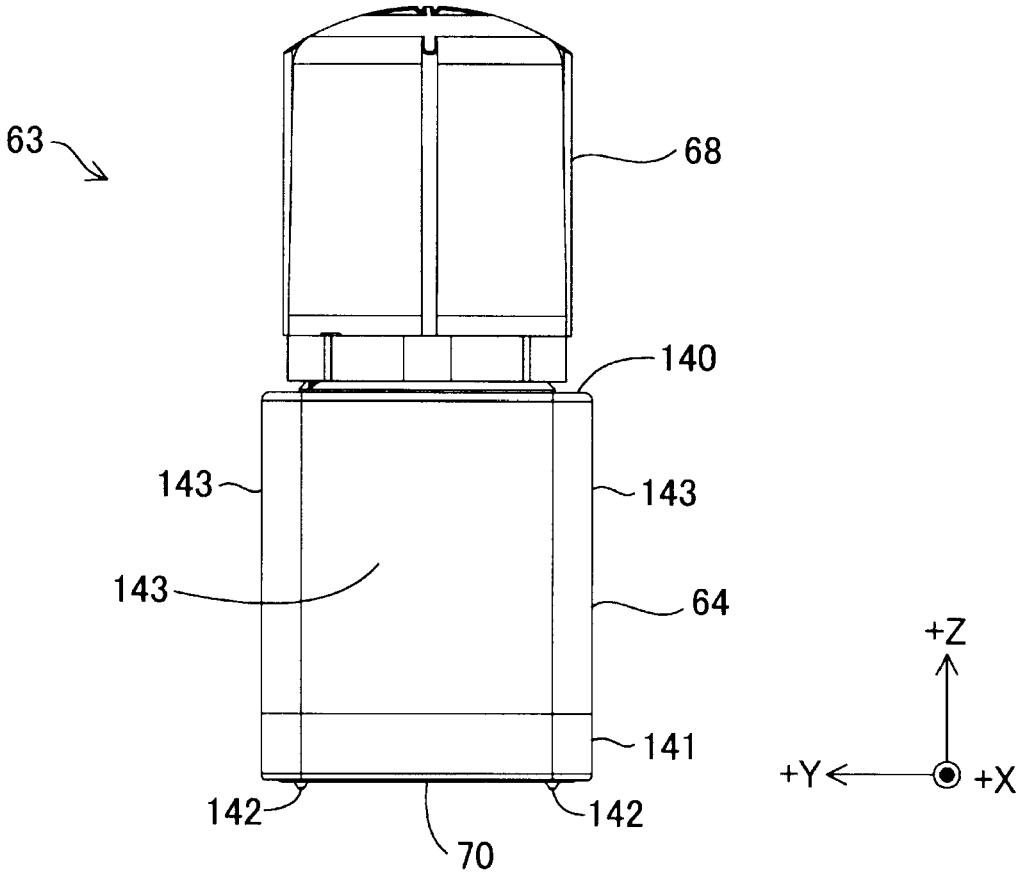
FIG. 6 is a side view of an ink replenishing container in a state where a cap is attached.
Figure 7:
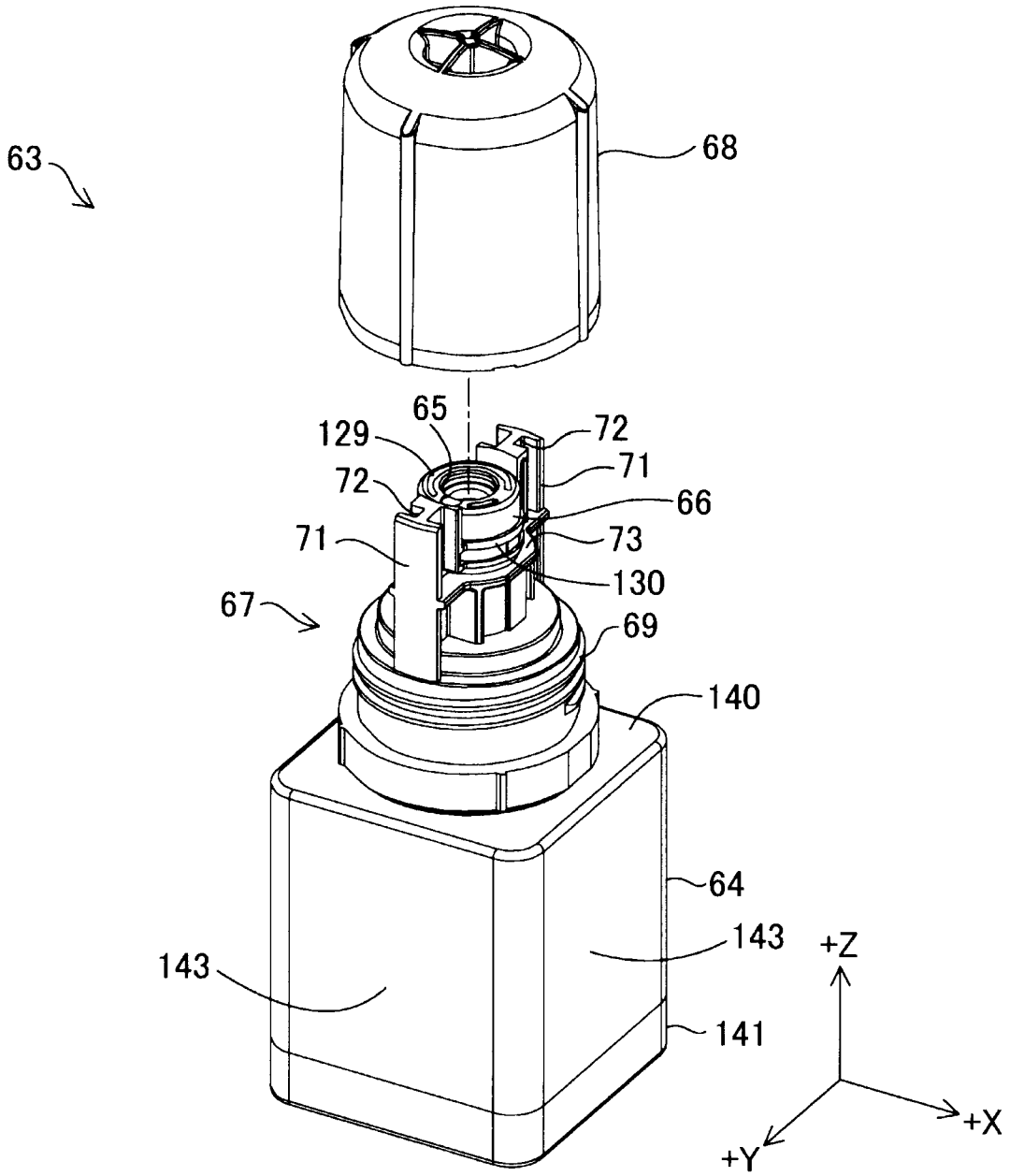
FIG. 7 is a perspective view of the ink replenishing container in a state where the cap is removed.
Figure 8:
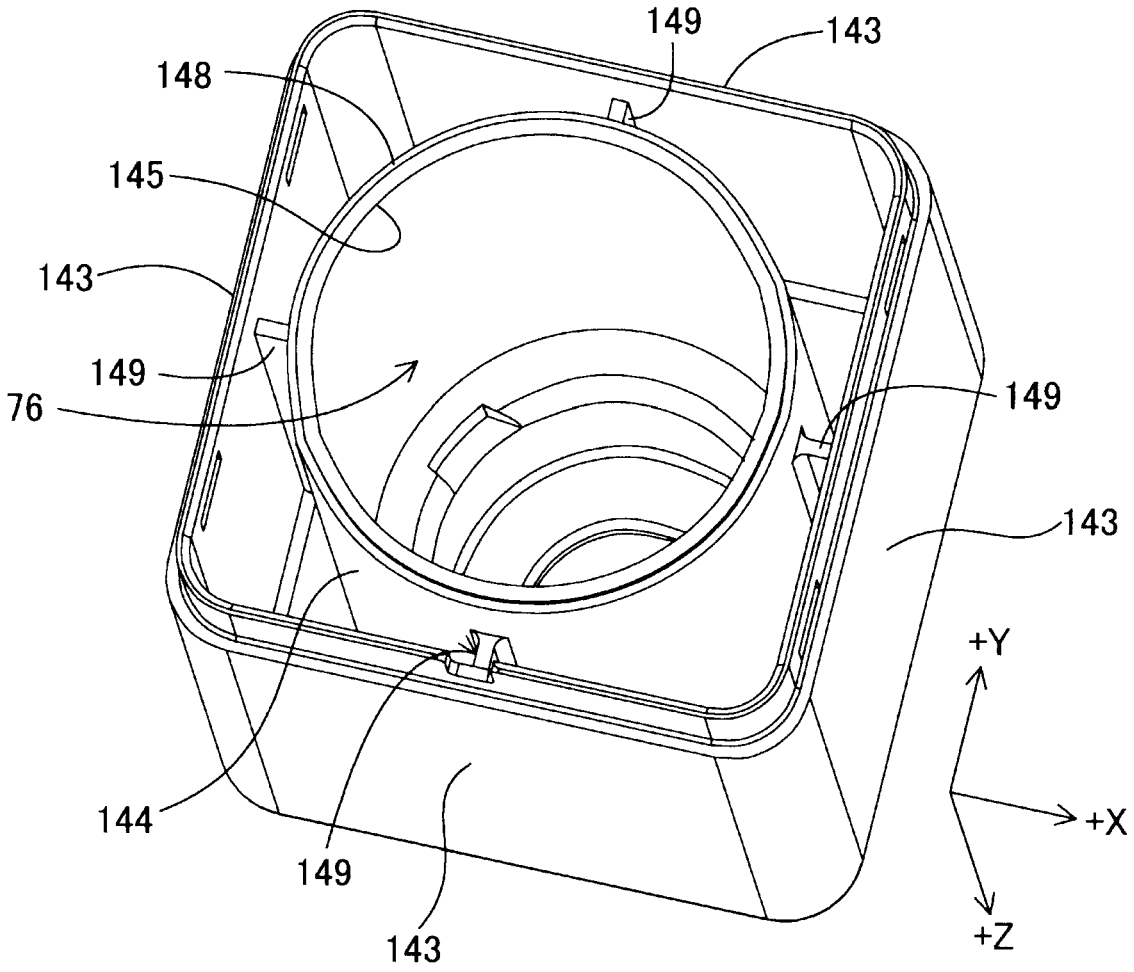
FIG. 8 is a perspective view illustrating an internal structure of a container main body portion.

FIG. 6 is a side view of the ink replenishing container 63 in a state where a cap 68 is attached. FIG. 7 is a perspective view of the ink replenishing container 63 in a state where the cap 68 is removed. FIG. 8 is a perspective view illustrating an internal structure of a container main body portion 64. The ink replenishing container 63 forms an ink replenishing system with the ink tanks 41 to 45, and is a container for replenishing the ink to the ink tanks 41 to 45 whose ink remaining amount is low. In the ink replenishing container 63, the downward direction is a direction facing a first bottom surface 147 described later from an upper surface 140 described later when the ink replenishing container 63 is placed on a table or the like. On the contrary, the upward direction is a direction facing the upper surface 140 from the first bottom surface 147 described later.

As illustrated in FIG. 7, the ink replenishing container 63 is provided with a container main body portion 64 as a main body thereof, an ink outlet forming portion 66 provided at a tip end portion of the container main body portion 64 and having an ink outlet 65 which allows the ink to flow out from the ink replenishing container 63 and is opened at the tip end, and a container addition portion 67 added to the ink outlet forming portion 66 so as to surround at least a portion of the ink outlet 65. Of the parts constituting the ink replenishing container 63, at least the container main body portion 64 is made of a transparent or translucent material. As such a material, for example, polypropylene can be used.

A cross section perpendicular to the vertical direction of the container main body portion 64 is substantially polygonal. In the present embodiment, the cross section perpendicular to the vertical direction of the container main body portion 64 is a rectangular shape. The container main body portion 64 has a box-like outer shape as a whole. The container main body portion 64 is provided with an upper surface 140 extending in the horizontal direction at the upper portion, and a cover 141 that covers the bottom portion of the container main body portion 64 at the lower portion. As will be described later, the cover 141 is attached to the container main body portion 64 as a separate member. An opening communicating with the ink outlet 65 is formed on the upper surface 140. A plurality of protrusions 142 are provided for causing the ink replenishing container 63 self-supporting (refer to FIG. 6) on a flat bottom surface of the cover 141. The bottom surface of the cover 141 is also referred to as a second bottom surface 70. In the present embodiment, the cover 141 has a substantially rectangular shape when viewed from below, and four protrusions 142 are provided at the four corners of the bottom surface of the cover 141 (refer to FIG. 10). The container main body portion 64 is provided with four outer walls 143 along the vertical direction. In the present embodiment, the outer wall 143 includes an outer wall formed on the cover 141. In the present embodiment, a corner where two adjacent outer walls 143 intersect is rounded and chamfered. The upper surface 140 intersects the four outer walls 143. In this specification, two objects "intersect" means any state of a state where two objects actually intersect each other, a state where an extension portion of one object intersects the other object, and a state where extension portions of each other intersect.

The ink outlet 65 illustrated in FIG. 7 communicates with an ink storage portion 76 (refer to FIG. 8). In the present embodiment, a groove 129 is formed at the tip end of the ink outlet 65. Furthermore, an annular projection portion 130 is formed between the tip end of the ink outlet 65 and a positioning portion 73 described later so as to be along an outer periphery of the ink outlet forming portion 66. It is possible to reduce the possibility of ink dripping from the ink outlet 65 by providing the groove 129 when the ink replenishing container 63 is erected after replenishing the ink to the ink tanks 41 to 45. Furthermore, the ink can be dammed by providing the annular projection portion 130 even when the ink is dripped from the ink outlet 65.

As illustrated in FIG. 7, the ink outlet forming portion 66 and the container addition portion 67 are provided above the upper surface 140 of the container main body portion 64. The ink outlet 65 formed by the ink outlet forming portion 66 is covered with the cap 68 including the surrounding container addition portion 67, so that the ink outlet 65 is concealed from the outside when the ink replenishing container 63 is stored. A first male screw portion 69 is formed on a outer peripheral surface of a cylindrical lower end portion of the container addition portion 67, while a female screw portion (not illustrated) is formed on an inner peripheral surface of the cap 68. The cap 68 is attached to the front end portion of the ink replenishing container 63 so as to cover the ink outlet 65 by screwing the first female screw portion formed on the cap 68 into the first male screw portion 69 of the container addition portion 67.

The entire outer surface of the container addition portion 67 is colored in a specific color. That is, the outer surface is colored in the same color as the color of the ink stored in the container main body portion 64 to which the container addition portion 67 is added. In this respect, the container addition portion 67 in the ink replenishing container 63 functions as a second portion that indicates information related to the ink contained in the ink replenishing container 63 to the outside. For example, the outer surface of the container addition portion 67 in the ink replenishing container 63 that stores the black ink is colored black. Furthermore, for example, the container main body portion 64 of the ink replenishing container 63 that stores the black ink may be formed thicker than the container main body portion 64 of the ink replenishing container 63 that stores the ink of other colors. In that case, the ink outlet forming portion 66 may have a common thickness and shape for the black ink and the other color inks.

A projection portion 71 that fits into the recessed portion 61 provided corresponding to the ink tanks 41 to 45 to which the ink is replenished is provided at least at a portion of a periphery of the ink outlet 65. More specifically, the projection portion 71 is formed so as to project upward along the direction of the central axis of the ink outlet 65 in the upper portion of the cylindrical lower end portion in which the first male screw portion 69 is formed on the outer peripheral surface of the container addition portion 67, in a region outside the ink outlet 65 in the radial direction with the ink outlet 65 as a center. The projection portion 71 functions as a second fitting portion that can be fitted with the recessed portion 61 of the upper surface 58 of the ink replenishing adapter 47 as the first fitting portion, when the tip end of the needle 56 on the ink inlet 53 side is inserted into the ink outlet 65. Similar to the pair of recessed portions 61 that interpose the ink inlet 53 from the front and rear, the projection portions 71 are provided so as to form a pair by interposing the ink outlet 65 from the front and rear. As illustrated in FIG. 7, the projection portion 71 is located inside the outer wall 143 of the container main body portion 64 in the radial direction with the ink outlet 65 as a center in the ink replenishing container 63.

In the present embodiment, the tip end of the projection portion 71 of the ink replenishing container 63 projects from the ink outlet 65 in the direction of the central axis of the ink outlet 65. Therefore, at the time of ink replenishment, the possibility that the ink outlet 65 touches the user's hand or the peripheral portion of the ink replenishing container 63 can be reduced, and the occurrence of contamination due to ink adhesion can be suppressed. In another embodiment, the tip end of the projection portion 71 may not project from the ink outlet 65 in the direction of the central axis of the ink outlet 65.

A second uneven portion 72 that can be engaged with the first uneven portion 62 formed on the inner surface of the recessed portion 61 of the ink replenishing adapter 47 is formed on the outer surface of each projection portion 71 in the left and right direction. The second uneven portion 72 is also referred to as a second key structure portion. The second uneven portion 72 is provided so as to extend along a projection direction of the projection portion 71, in other words, the direction of the central axis of the ink outlet 65, fits the projection portion 71 into the recessed portion 61, and couples the ink outlet 65 of the ink replenishing container 63 to the ink inlet 53 on the ink tanks 41 to 45 side when the second uneven portion 72 is engaged with the first uneven portion 62.

Between the cylindrical lower end portion where the first male screw portion 69 of the container addition portion 67 is formed and the projection portion 71 where the second uneven portion 72 is formed, a planar positioning portion 73 intersecting, preferably perpendicular to the central axis of the ink outlet 65 is provided so as to be positioned on the radially outer side of the ink outlet 65 when the ink outlet 65 is viewed in the direction of the central axis. The positioning portion 73 forms a portion of the outer surface of the container addition portion 67 that is a portion of the outer surface of the ink replenishing container 63. The positioning portion 73 is provided at a position closer to the container main body portion 64 side than the tip end of the projection portion 71 in the direction of the central axis of the ink outlet 65.

As illustrated in FIG. 8, a cylindrical inner wall 144 is provided inside the container main body portion 64. The inner wall 144 is also referred to as a "first side wall", and the outer wall 143 is also referred to as a "second side wall". The inner wall 144 and the outer wall 143 intersect the upper surface 140. The inner wall 144 defines a portion of the ink storage portion 76 that stores the ink. On the other hand, the ink stored in the ink storage portion 76 is not in contact with the outer wall 143. In the present embodiment, since the inner wall 144 is cylindrical and the outer wall 143 has a rectangular cross section, an interval between the inner wall 144 and the outer wall 143 in the horizontal direction is not constant. The cylindrical inner wall 144 is formed so that the inner diameter increases toward the lower side. Therefore, undercutting is not required, and it can be manufactured at low cost by injection molding.

Figure 9:
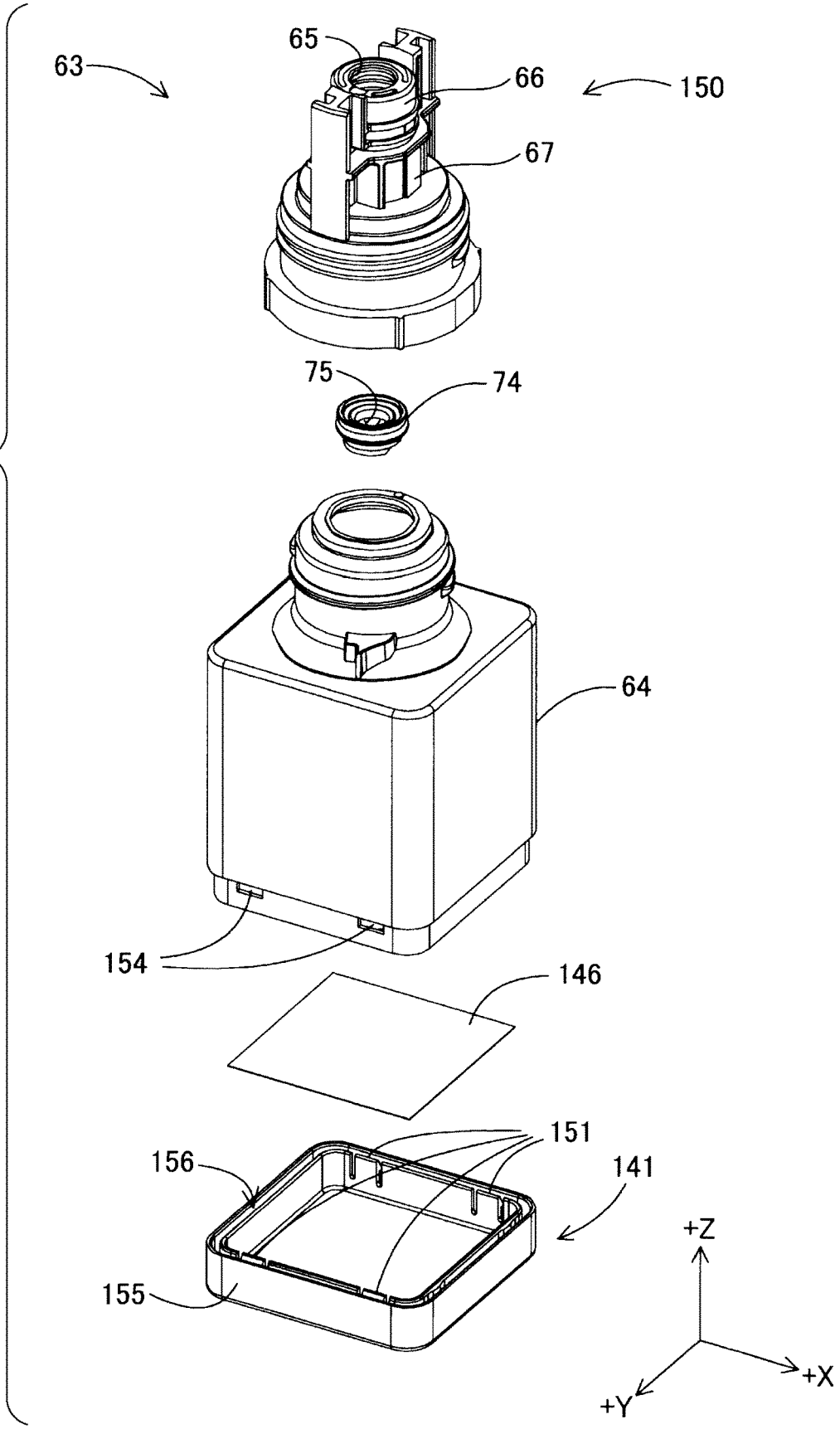
FIG. 9 is a first exploded perspective view of the ink replenishing container.
Figure 10:
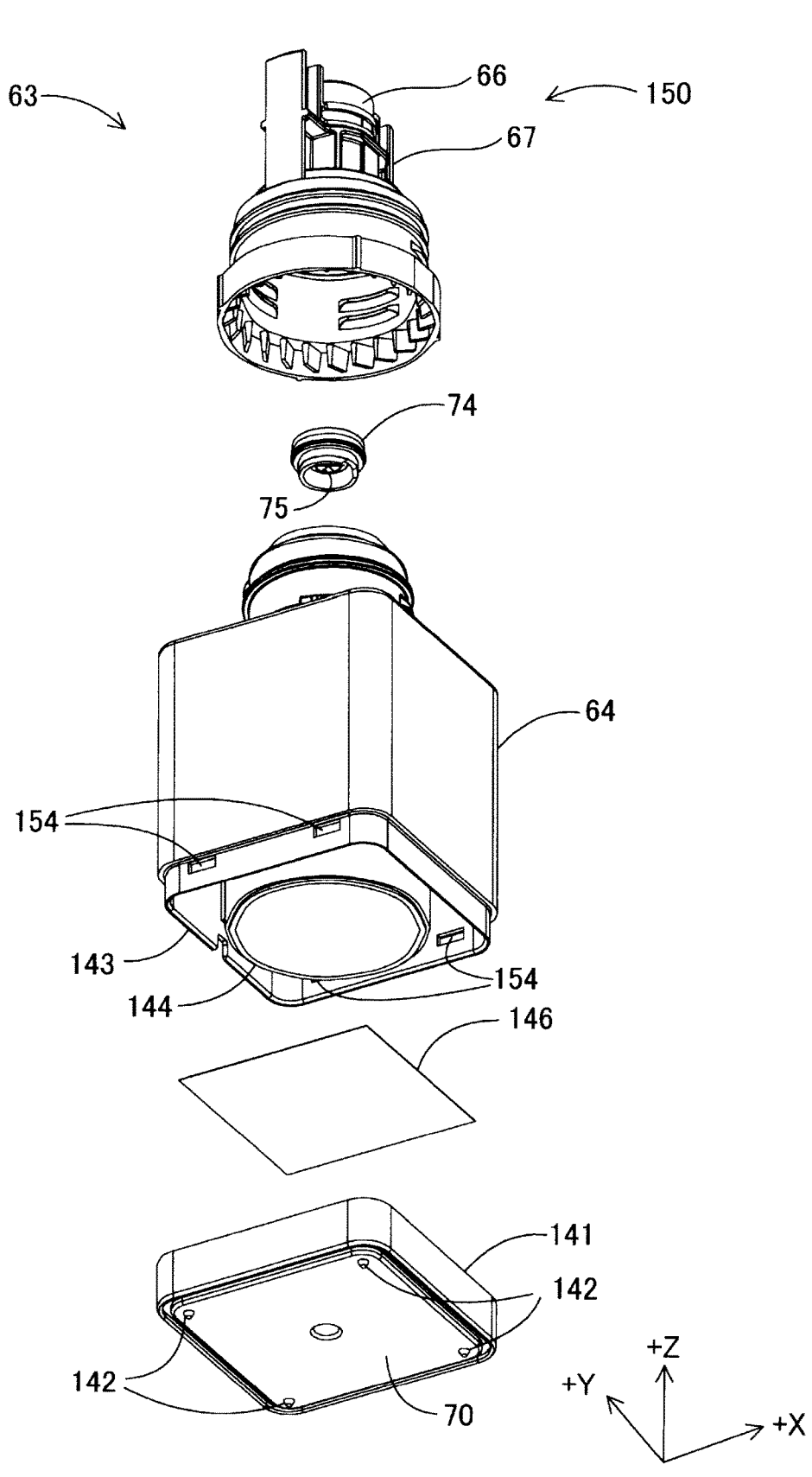
FIG. 10 is a second exploded perspective view of the ink replenishing container.

As illustrated in FIG. 8, in the present embodiment, the lower portion of the outer wall 143 and the lower portion of the inner wall 144 are opened. An opening portion of the outer wall 143 is closed by the cover 141. On the other hand, the opening portion 145 of the inner wall 144 is closed when film members 146 illustrated in FIGS. 9 and 10 are welded to a welded surface 148 which is the lower surface of the inner wall 144. The inner wall 144 and the outer wall 143 are in a relationship intersecting with the film member 146. The film member 146 and the welded surface 148 are in a positional relationship parallel to the upper surface 140 described above. That is, the upper surface 140 is formed above the film member 146 and along the direction in which the film member 146 extends.

The film member 146 is made of, for example, polypropylene or polyethylene terephthalate. A gap is formed between the film member 146 and the cover 141 to allow the film member 146 to bend. In other embodiments, no gap may be formed between the film member 146 and the cover 141. The film member 146 forms the first bottom surface 147 that defines a portion of the ink storage portion 76. That is, in the present embodiment, the ink storage portion 76 has a lower surface defined by the first bottom surface 147 and a side surface defined by the inner wall 144. The upper portion of the ink storage portion 76 communicates with the ink outlet 65 through the opening formed on the upper surface 140 and the ink outlet forming portion 66. The second bottom surface 70 formed by the cover 141 is disposed below the first bottom surface 147. Although the ink stored in the ink storage portion 76 is in contact with the first bottom surface 147, the ink is not in contact with the second bottom surface 70.

In the present embodiment, the inner wall 144 and the outer wall 143 are coupled by a plurality of flat reinforcing ribs 149 along the vertical direction. In the present embodiment, the reinforcing rib 149 is disposed between the inner wall 144 and the outer wall 143 along a virtual plane that couples center lines along the vertical direction of the two facing outer walls 143. In another embodiment, the reinforcing rib 149 may be disposed between the inner wall 144 and the outer wall 143 along a virtual plane that couples the corner portions of the ink replenishing container 63 that extend in the vertical direction, and face each other. In the present specification, two objects "facing" means to include both the case where other object is absent between the two objects and the case where other object is present.

Figure 11:
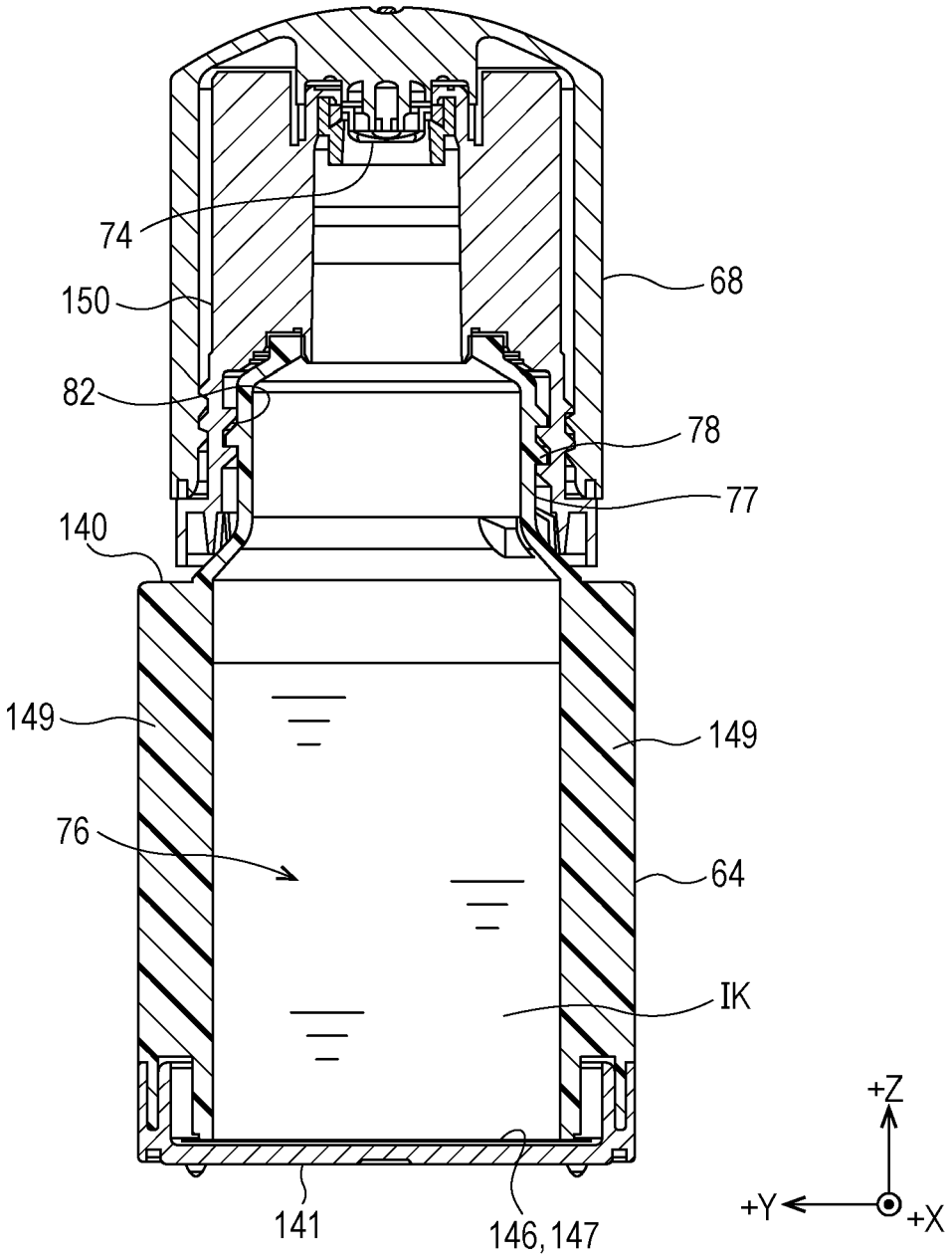
FIG. 11 is a longitudinal sectional view of the ink replenishing container.

FIG. 9 is a first exploded perspective view of the ink replenishing container 63. FIG. 10 is a second exploded perspective view of the ink replenishing container 63. FIG. 11 is a longitudinal sectional view of the ink replenishing container 63. FIG. 11 illustrates a cross section of the ink replenishing container 63 at a position where the reinforcing rib 149 exists. As illustrated in these drawings, the ink replenishing container 63 is configured by assembling a spout portion 150, a valve 74, the container main body portion 64, the film member 146, and the cover 141. The spout portion 150 is integrally provided with the ink outlet 65, the ink outlet forming portion 66, and the container addition portion 67 (refer to FIG. 7).

In the ink outlet 65 formed in the ink outlet forming portion 66, the valve 74 made of, for example, an elastic member such as a silicon film for sealing the ink outlet 65 so as to be opened and closed is provided. The valve 74 is provided on the tip end side than the positioning portion 73 in the direction of the central axis of the ink outlet 65. The valve 74 is provided with a plurality of slits 75 intersecting at equal angular intervals with the center thereof as an intersection, and these slits 75 are configured to be opened by being spread from the outside to the inside of the ink outlet 65. That is, when the tip end of the needle 56 on the ink inlet 53 side is inserted into the ink outlet 65, the valve 74, which is a normally closed valve, is pushed inward and opened by the tip end of the needle 56. The valve 74 is also referred to as a slit valve.

When the tip end of the needle 56 on the ink inlet 53 side is inserted into the ink outlet 65 and the valve 74 is opened, the positioning portion 73 abuts on the upper surface 58 of the ink replenishing adapter 47 in which the through-hole 60 including the ink inlet 53 and the recessed portion 61 is formed, and positions the valve 74 with respect to the ink tanks 41 to 45 in the direction of the central axis of the ink outlet 65. In this respect, when the valve 74 of the ink outlet 65 of the ink replenishing container 63 is opened to replenish the ink to the ink tanks 41 to 45, the upper surface 58 of the ink replenishing adapter 47 is a portion of the ink tanks 41 to 45 side on which the positioning portion 73 of the ink replenishing container 63 abuts, and functions as a receiving surface that receives the planar positioning portion 73.

As illustrated in FIG. 11, the container main body portion 64 in the ink replenishing container 63 is a bottle-shaped member having the ink storage portion 76 that can store the ink IK therein, and a second male screw portion 78 is formed on an outer peripheral surface of a neck portion 77 provided at the upper end portion thereof. On the other hand, a second male screw portion 82 is formed on the inner peripheral surface of the lower portion of the spout portion 150 provided at the upper end portion of the container main body portion 64. The spout portion 150 is attached to the upper portion of the container main body portion 64 by screwing the second female screw portion 82 into the second male screw portion 78 formed in the neck portion 77 of the container main body portion 64.

Figure 12:
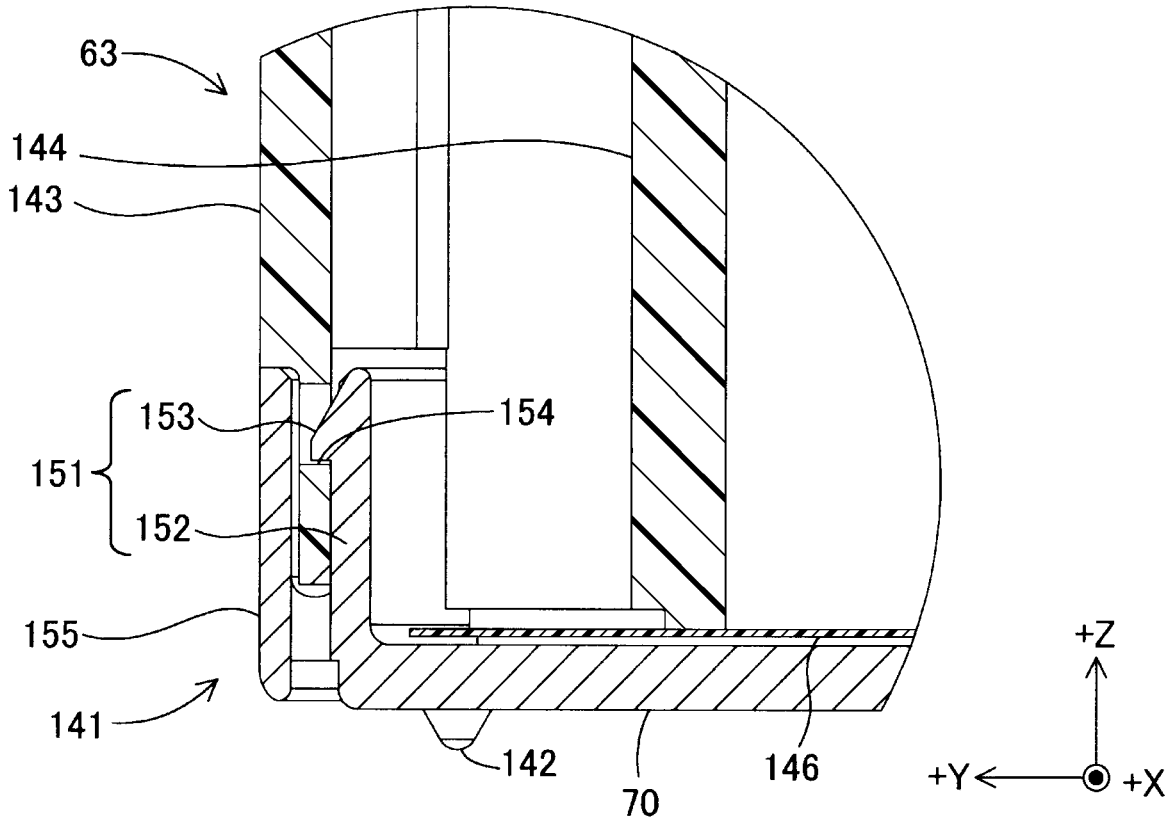
FIG. 12 is a partial cross-sectional view illustrating a coupling structure between a cover and the container main body portion.

FIG. 12 is a partial cross-sectional view illustrating a coupling structure between the cover 141 and the container main body portion 64. As illustrated in FIGS. 9 and 12, the cover 141 includes a plurality of fixing portions 151. Each of the fixing portions 151 is provided with a plate-like portion 152 that extends in the vertical direction and a claw portion 153 that faces outward at the tip end of the plate-like portion 152. As illustrated in FIGS. 10 and 12, a plurality of engagement portions 154 are formed on the outer wall 143 of the container main body portion 64. The engagement portion 154 is configured by forming a through-hole in the outer wall 143. The fixing portion 151 and the engagement portion 154 form a so-called snap fit structure. In the present embodiment, as illustrated in FIG. 12, the claw portion 153 provided in the fixing portion 151 engages with the engagement portion 154 facing outward.

As illustrated in FIGS. 9 and 12, the cover 141 includes an engagement wall 155 that stands upward from the outer peripheral portion of the second bottom surface 70 of the cover 141. The engagement wall 155 has a double structure, a fixing portion 151 is formed on the inner wall, and the lower end of the outer wall 143 of the container main body portion 64 fits into a groove portion 156 defined between the inner wall and the outer wall. The lower end of the outer wall 143 is formed thinner than the other portions so that the outer surfaces of the container main body portion 64 and the cover 141 are flush with each other when the lower end of the outer wall 143 fits into the groove portion 156. When the lower end of the outer wall 143 of the container main body portion 64 fits into the groove portion 156, the fixing portion 151 is pushed inward by the elasticity of the plate-like portion 152. Thereafter, when the engagement portion 154 moves to a position corresponding to the claw portion 153 of the fixing portion 151, the claw portion 153 is fitted into the engagement portion 154, and the cover 141 is fixed to the container main body portion 64. A hole portion or the like is not provided in the outer wall of the engagement wall 155 provided in the cover 141. Therefore, once the cover 141 is attached to the container main body portion 64 by the fixing portion 151 and the engagement portion 154, the cover 141 is not easily removed from the container main body portion 64.

Figure 13:
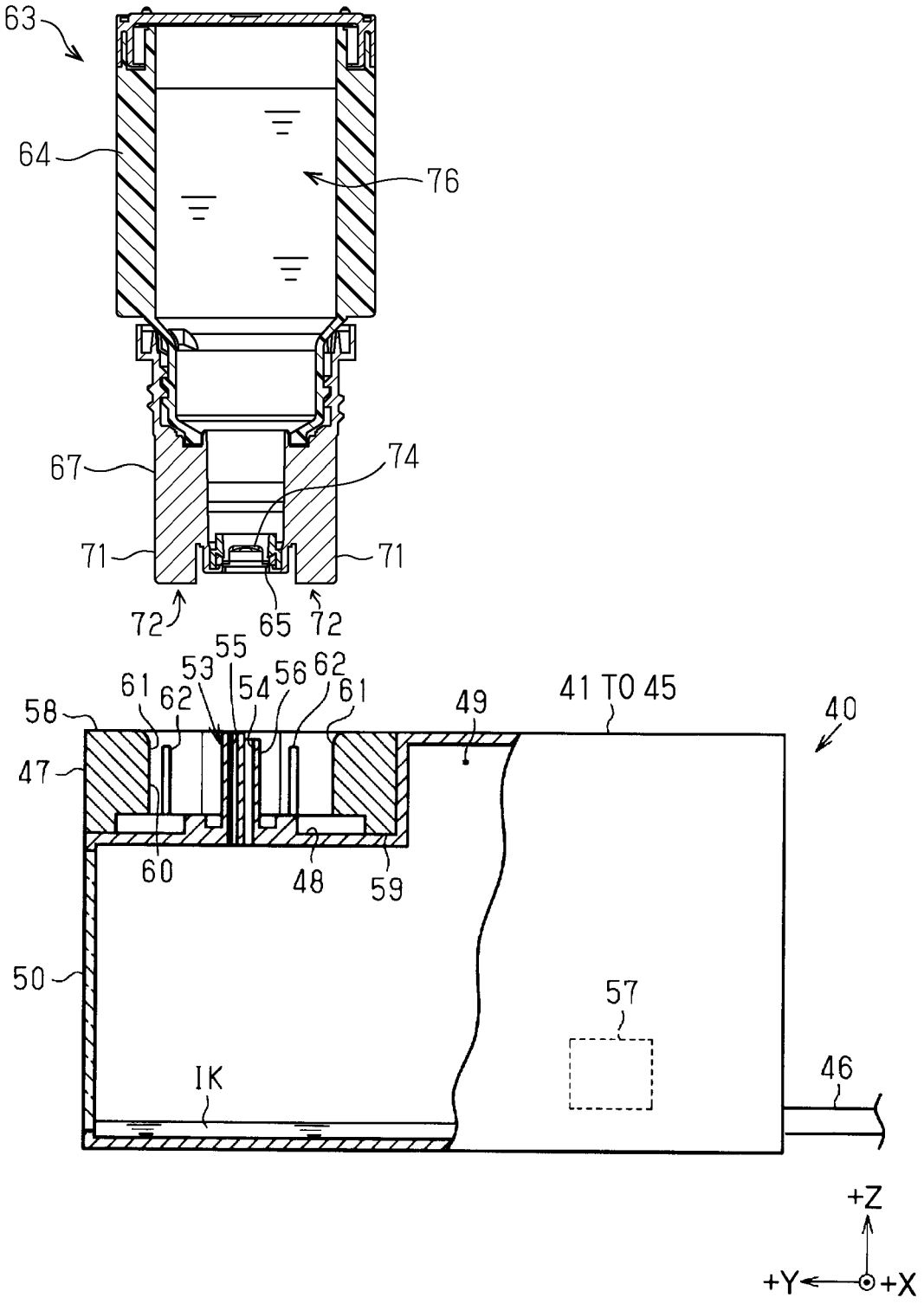
FIG. 13 is a partially broken side view illustrating a state immediately before an ink replenishing operation.
Figure 14:
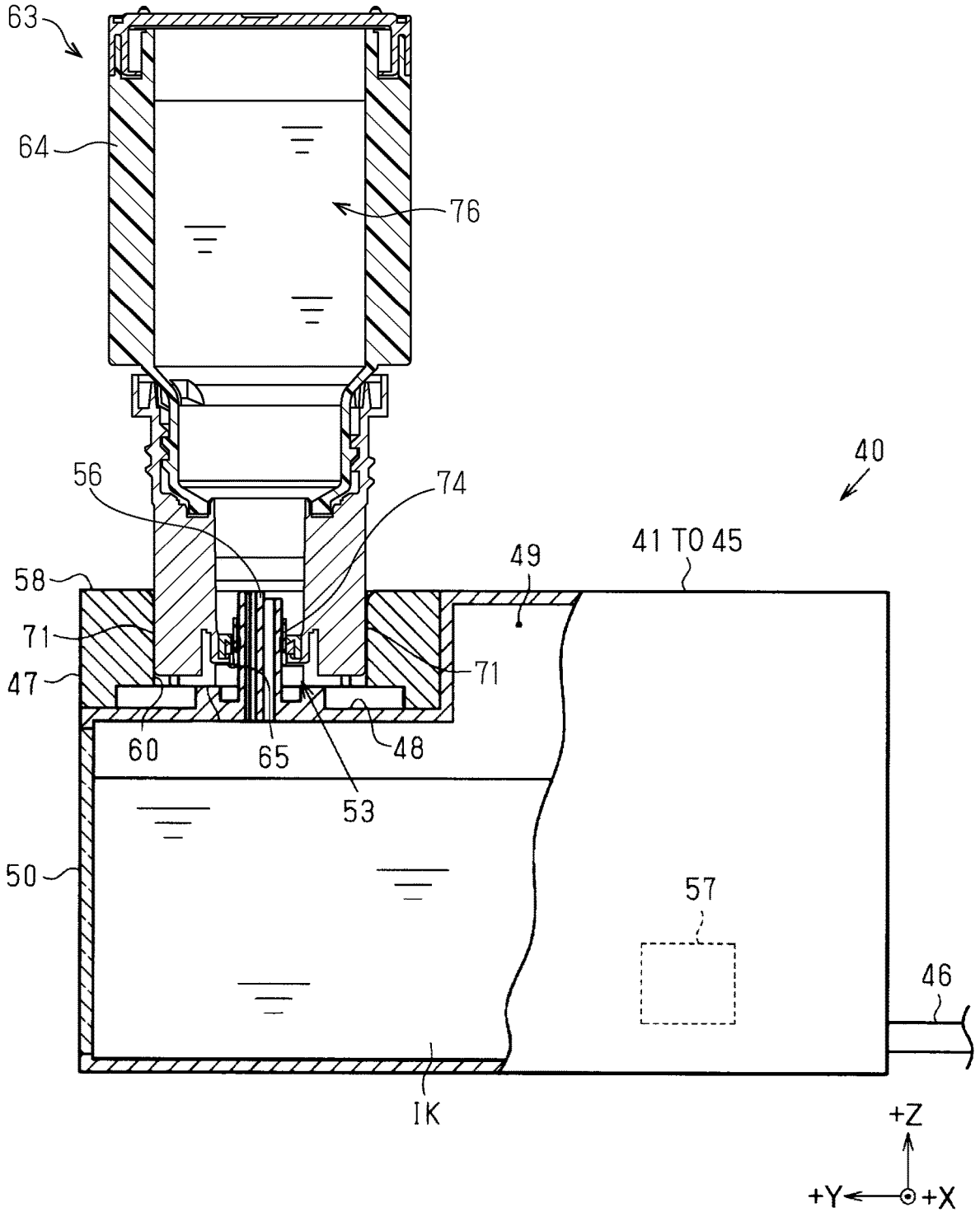
FIG. 14 is a partially broken side view illustrating a state during the ink replenishing operation.
Figure 15:
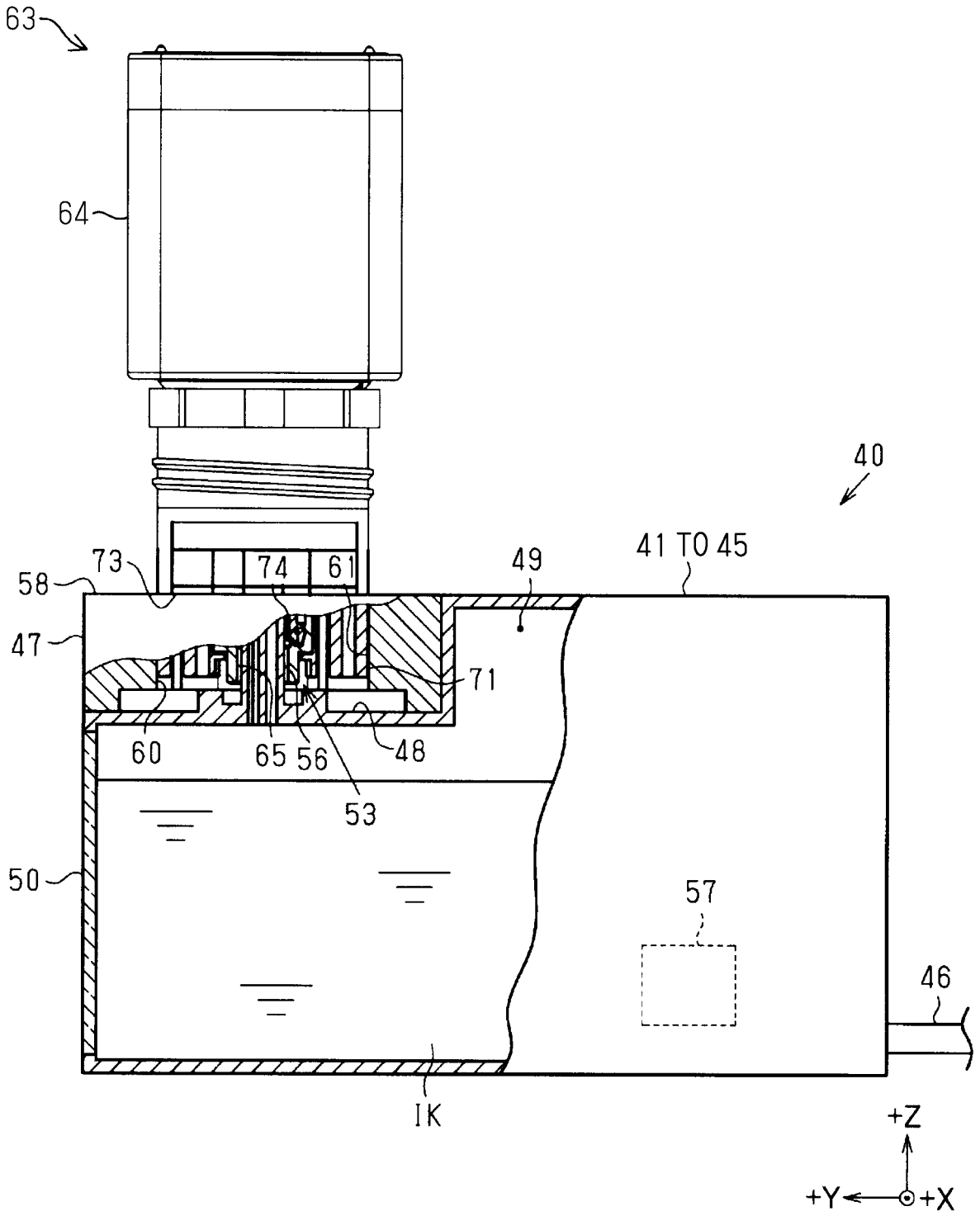
FIG. 15 is a partially broken side view illustrating a state where a positioning portion of the ink replenishing container abuts on a receiving surface on an ink tank side.

FIG. 13 is a partially broken side view illustrating a state immediately before an ink replenishing operation. FIG. 14 is a partially broken side view illustrating a state during the ink replenishing operation. FIG. 15 is a partially broken side view illustrating a state where the positioning portion of the ink replenishing container abuts on the receiving surface on the ink tank side. The operation of the ink replenishing system configured as described above will be described below by focusing on the operation when the ink is replenished to the ink tanks 41 to 45 of the ink supply unit 40 using the ink replenishing container 63. As a premise, as illustrated in FIG. 2, since the liquid level of the ink in the black ink tank 41 located on the rightmost side among the plurality of ink tanks 41 to 45 arranged side by side is lowered to the height of the lower limit mark 52 marked at the lower portion of the visual recognition portion 50, the case where the ink is replenished to the ink tank 41 will be described below. In addition, it is assumed that the black ink is sufficiently stored in the ink replenishing container 63 used for the ink replenishment, and the cap 68 is removed from the ink replenishing container 63 in advance. Furthermore, it is assumed that the shape of the second uneven portion 72 formed on the outer surface of the projection portion 71 of the ink replenishing container 63 matches the shape of the first uneven portion 62 formed on the inner surface of the recessed portion 61 located before and after the ink inlet 53 to the ink tank 41, and can be engaged with the insertion of the projection portion 71 into the recessed portion 61.

When the ink is replenished to the ink tank 41, first, the user rotates the opening/closing door 35 of the housing 22 forward about the rotation shaft 36 from a closed state illustrated in FIG. 1 to an open state. As a result, in the ink supply unit 40, the upper surface 58 of the ink replenishing adapter 47 in which the ink inlet 53 into each of the ink tanks 41 to 45 is formed is exposed to the outside of the housing 22. The user can couple the ink outlet 65 of the ink replenishing container 63 from above to the desired ink inlet 53.

Therefore, as illustrated in FIG. 13, the user holds the ink replenishing container 63 containing the black ink used for the ink replenishment upside down, so that the ink outlet 65 is positioned above the rightmost through-hole 60 in the ink replenishing adapter 47. That is, the central axis of the ink outlet 65 of the ink replenishing container 63 is aligned with the central axis of the ink inlet 53 of the ink tank 41 to be replenished with the ink. At this time, the user compares a color colored in the container addition portion 67 of the ink replenishing container 63 held in the hand with a color colored around the opening edge on the upper side of the through-hole 60 provided with the ink inlet 53 of the ink tank 41 to be replenished with the ink at that time. When each of the colors are the same as each other, it is confirmed that the ink replenishing container 63 suitable for the current ink replenishment is held in the hand, and the step proceeds to a subsequent operation in the ink replenishment.

The ink replenishing container 63 is lowered from the state illustrated in FIG. 13, and the projection portion 71 of the ink replenishing container 63 is inserted into the recessed portion 61 of the ink replenishing adapter 47 integrated with the ink tank 41. As a result, by realizing the insertion state of the projection portion 71 into the recessed portion 61, a match state of the central axis of the ink outlet 65 with respect to the central axis of the ink inlet 53 is ensured. In this case, since the recessed portion 61 is in a point-symmetrical position with respect to the needle 56 that is the center of the ink inlet 53, the projection portion 71 can be inserted into any recessed portion 61. Therefore, there is no need to rotate the ink replenishing container 63 around the central axis of the ink outlet 65 many times to confirm the suitable positional relationship between the recessed portion 61 and the projection portion 71, and the user can easily perform an insertion work of the projection portion 71 into the recessed portion 61.

When the projection portion 71 is further inserted downward in the depth direction of the recessed portion 61 from a state where the projection portion 71 is slightly inserted into the recessed portion 61, the second uneven portion 72 on the outer surface of the projection portion 71 engages with the first uneven portion 62 on the inner surface of the recessed portion 61. When the projection portion 71 is further inserted toward the bottom surface in the depth direction of the recessed portion 61 while maintaining the engaged state, the tip end of the needle 56 of the ink inlet 53 reaches the position of the valve 74 of the ink outlet 65, and the valve 74 is opened.

That is, as illustrated in FIG. 14, the tip end of the needle 56 pushes the slit 75 from the lower side to the upper side, in other words, from the outside to the inside of the ink outlet 65, with respect to the valve 74, so that the valve 74 is opened. As a result, the ink outlet 65 of the ink replenishing container 63 and the needle 56 of the ink inlet 53 of the ink tank 41 are coupled to each other, and the black ink is replenished from the ink replenishing container 63 into the ink tank 41. At this time, in the needle 56 of the ink inlet 53, among the two flow paths 54 and 55, one flow path where the tip end opening first touches the ink flowing out from the ink outlet 65 by opening the valve 74 functions as an ink flow path through which the ink flows, and the other flow path functions as an air flow path through which air flows. For example, when the user tries to couple the ink outlet 65 to the ink inlet 53 in a state where the ink replenishing container 63 is tilted, the flow path serving as the ink flow path of the two flow paths 54 and 55 is also changed due to the difference in the tilting direction.

When the second uneven portion 72 does not engage with the first uneven portion 62 after inserting the projection portion 71 into the recessed portion 61, at that time, the user can recognize that the ink replenishing container 63 of a color other than black is erroneously inserted. In this case, when the upper end of the first uneven portion 62 is positioned at the same height as the opening edge of the recessed portion 61, not only is the engagement of the second uneven portion 72 with the first uneven portion 62 rejected, but also the insertion of the projection portion 71 into the recessed portion 61 is rejected. Therefore, the user may try to insert the projection portion 71 into the recessed portion 61 many times, and wastefully spend unnecessary work time. In this respect, in the present embodiment, since the height of the first uneven portion 62 is lower than the opening edge of the recessed portion 61, when the projection portion 71 is inserted into the recessed portion 61, the projection portion 71 is likely to be guided to the bottom surface side in the depth direction of the recessed portion 61, and the work time is prevented from being unnecessarily prolonged.

Furthermore, as illustrated in FIGS. 14 and 15, when the needle 56 of the ink inlet 53 on the ink tank 41 side opens the valve 74 in the ink outlet 65 of the ink replenishing container 63, the positioning portion 73 of the ink replenishing container 63 abuts on the upper surface 58 of the ink replenishing adapter 47 that is a portion of the ink tank 41 side. That is, the ink replenishing container 63 is opened in a state where the valve 74 is positioned in the direction of the central axis of the ink outlet 65 with respect to the needle 56 on the ink tank 41 side by the positioning portion 73 abutting on the upper surface 58 of the ink replenishing adapter 47.

In addition, at that time, since the positioning portion 73 is positioned on the radially outer side of the ink outlet 65, the ink replenishing container 63 is stably held in the posture in which the ink outlet 65 is coupled to the ink inlet 53. In addition, when the positioning portion 73 of the ink replenishing container 63 abuts on the upper surface 58 of the ink replenishing adapter 47, there is a gap between the bottom surface of the ink inlet 53 where the base end of the needle 56 in the ink inlet 53 is positioned and the tip end of the ink outlet 65 of the ink replenishing container 63. Therefore, the ink is likely to be accumulated on the bottom surface of the ink inlet 53 where the base end of the needle 56 is positioned, and it is also avoided that the ink accumulated in this manner adheres to the tip end of the ink outlet 65 to contaminate the ink replenishing container 63.

When the ink replenishment from the ink replenishing container 63 to the ink tank 41 is completed, in a case in which the liquid level of the ink in the ink tank 41 is still lower than the upper limit mark 51 of the visual recognition portion 50, furthermore, the ink replenishment may be performed to further add up to the upper limit mark 51 using the same black ink replenishing container 63. The ink replenishing operation described above is performed in the same manner for the ink tanks 42 to 45 of other colors other than the black ink tank 41.

(1-1) According to the first embodiment described above, since the outer wall 143 is disposed outside the inner wall 144 that defines the ink storage portion 76, even when the side surface of the container main body portion 64 is strongly pressed by the user, it is possible to suppress a change in the volume of the ink storage portion 76. Therefore, when the ink is replenished, it is possible to reduce the possibility of ink ejecting vigorously from the ink outlet 65 to stain the surroundings. In addition, since the outer wall 143 is disposed outside the inner wall 144 that defines the ink storage portion 76, the ink storage portion 76 can be prevented from being damaged when the ink replenishing container 63 drops from the side surface. Therefore, the ink can be prevented from leaking due to dropping or the like. In addition, in the present embodiment, since the needle 56 is provided with two flow paths 54 and 55, the one functions as an air flow path, and the other functions as an ink flow path, gas-liquid exchange is favorably performed at the time of ink replenishment. Therefore, the ink flows from the ink replenishing container 63 into the ink tanks 41 to 45 without squeezing the ink replenishing container 63. In the present embodiment, since the side surface of the container main body portion 64 has a double structure of the inner wall 144 and the outer wall 143, it is possible to prevent the ink replenishing container 63 from being forcibly squeezed by the user.

(1-2) The ink replenishing container 63 of the present embodiment is provided with the cover 141 that intersects the outer wall 143, is disposed below the first bottom surface 147, and is not in contact with the ink. Therefore, it is possible to more effectively suppress damage to the ink storage portion 76 due to dropping or the like.

(1-3) In the ink replenishing container 63 of the present embodiment, the interval between the inner wall 144 and the outer wall 143 is not constant. Therefore, the design of the ink replenishing container 63 and the degree of freedom of design are increased.

(1-4) In the present embodiment, the inner wall 144 has a circular cross-sectional shape, and the outer wall 143 has a polygonal cross-sectional shape. Therefore, the pressure resistance of the ink storage portion 76 is improved, and furthermore, the possibility that the ink replenishing container 63 rolls and drops from a high place and is damaged can be reduced. The cross-sectional shape of the outer wall 143 is substantially rectangular in the present embodiment, may be a triangle, or may be a polygon of a pentagon or more.

(1-5) The ink replenishing container 63 of the present embodiment is provided with the reinforcing rib 149 that couples the inner wall 144 and the outer wall 143. Therefore, since the rigidity of the ink replenishing container 63 can be increased, it is possible to more effectively suppress the ink from ejecting due to a change in the volume of the ink storage portion 76 when the side surface is strongly pressed by the user. In addition, it is possible to suppress deformation of the ink replenishing container 63 when the ink replenishing container 63 is sealed in a bag and depressurized for transport and sale of the ink replenishing container 63.

(1-6) The ink replenishing container 63 of the present embodiment is provided with the valve 74 having the slit 75 at the ink outlet 65. Therefore, the ink can be replenished to the ink tanks 41 to 45 from the ink outlet 65 with a simple configuration. In addition, in the present embodiment, since the container main body portion 64 has a double structure having the inner wall 144 and the outer wall 143, rigidity is high. Therefore, it is possible to prevent the ink from leaking from the slit 75 by strongly pressing the side surface of the container main body portion 64.

(1-7) The ink replenishing container 63 of the present embodiment includes the projection portion 71 that fits into the recessed portion 61 provided in each of the ink tanks 41 to 45 at least at a portion of the periphery of the ink outlet 65. Therefore, the ink replenishing container 63 can be stably coupled to the ink tank 41.

(2-1) The ink replenishing container 63 of the present embodiment is provided with the inner wall 144 defining the ink storage portion 76 for storing the ink and having the opening portion 145 at the lower portion, the ink outlet 65 communicating with the ink storage portion 76, and the film member 146 closing the opening portion 145. Therefore, even when the ink in the ink storage portion 76 flows in a case in which the side surface of the container main body portion 64 is strongly pressed by the user, since the flow can be received by the film member 146, it is possible to prevent the ink from leaking from the ink replenishing container 63 at a joint portion between the film member 146 and the inner wall 144. In addition, when the volume of the ink changes due to the influence of the external temperature, since the film member 146 can cause the volume of the ink storage portion 76 to follow the change in the volume of the ink, it is possible to prevent the ink replenishing container 63 from being damaged or the ink from leaking to the outside.

(2-2) The ink replenishing container 63 of the present embodiment is provided with the upper surface 140 disposed above the film member 146 along the direction where the film member 146 extends. Therefore, when the ink replenishing container 63 is manufactured, the ink replenishing container 63 is turned upside down and the ink replenishing container 63 is supported by the upper surface 58, so that the film member 146 can be easily joined to the welded surface 148 of the inner wall 144 from above.

(2-3) The ink replenishing container 63 of the present embodiment is provided with the cover 141 below the film member 146. Therefore, damage to the film member 146 can be suppressed even when an external impact or the like is applied.

(2-4) The cover 141 of the ink replenishing container 63 of the present embodiment has the claw portion 153 for fixing to a peripheral portion thereof. The outer wall 143 on the outer peripheral side of the inner wall 144 is provided with the engagement portion 154 with which the claw portion 153 is engaged. In the present embodiment, since the claw portion 153 is engaged with the engagement portion 154 facing outward, it is possible to suppress the cover 141 from being easily detached from the ink replenishing container 63.

(2-5) The ink replenishing container 63 of the present embodiment has the plurality of protrusions 142 on the lower surface of the cover 141. Therefore, even when the ink replenishing container 63 drops from the lower side, the impact can be mitigated by the protrusion 142, so that the ink replenishing container 63 can be prevented from being damaged. In addition, since the plurality of protrusions 142 are provided on the lower surface of the cover 141, even when the cover 141 is distorted, rattling can be suppressed when the ink replenishing container 63 is placed on a table or the like.

(3-1) In the present embodiment, when the ink is replenished from the ink replenishing container 63 to the ink tanks 41 to 45, the valve 74 is opened while being positioned with respect to the ink tanks 41 to 45. Therefore, problems such as the ink leakage and the ink replenishment failure that may occur when the valve 74 is displaced at the time of valve opening can be suppressed, and the ink can be replenished appropriately to the ink tanks 41 to 45.

(3-2) In the present embodiment, since the valve 74 is configured to include the slit valve in which one or more slits 75 are provided in an elastic member made of a silicon film or the like, the ink replenishing container 63 having a simple structure can be provided with a small number of parts.

(3-3) In the present embodiment, when the ink is replenished from the ink replenishing container 63 to the ink tanks 41 to 45, the ink replenishing container 63 abuts on a portion of the ink tanks 41 to 45 in a state where the positioning portion 73 is positioned on the radially outside of the ink outlet 65. Therefore, the ink can be replenished in a stable posture.

(3-4) In the present embodiment, when the needles 56 of the ink tanks 41 to 45 are inserted into the ink outlet 65 of the ink replenishing container 63 and the valve 74 is opened, in the ink tanks 41 to 45, the positioning portion 73 of the ink replenishing container 63 abuts on the upper surface 58 of the ink replenishing adapter 47 that functions as the receiving surface of the ink replenishing container 63, and the relative positional relationship between the valve 74 and the needle 56 is determined. Therefore, the valve 74 can be appropriately opened by the needle 56, and the occurrence of ink replenishment failure can be suppressed.

(3-5) In the present embodiment, at the time of ink replenishment, the needle 56 is not inserted into the ink outlet 65 in a state where the projection portion 71 of the ink replenishing container 63 does not fit into the recessed portion 61 of each of the ink tanks 41 to 45. Therefore, an inadequate coupling between the ink tanks 41 to 45 and the ink replenishing container 63 can be suppressed.

(3-6) The ink replenishing container 63 of the present embodiment is provided with the positioning portion 73 outside the ink outlet forming portion 66 and at a position closer to the container main body portion 64 than the projection portion 71 in the direction of the central axis of the ink outlet 65. Therefore, the inadequate coupling between the ink tanks 41 to 45 and the ink replenishing container 63 is suppressed, and the insertion state of the needles 56 of the ink tanks 41 to 45 into the ink outlet 65 of the ink replenishing container 63 is ensured in an appropriate positioning state.

(3-7) In the present embodiment, the needles 56 of the ink tanks 41 to 45 do not project outward from the upper surface 58 of the ink replenishing adapter 47 whose tip end is the receiving surface of the positioning portion 73 of the ink replenishing container 63. Therefore, even when the ink is attached to the tip end of the needle 56, it is possible to reduce the possibility that the ink adheres to the hand of the user who performs the ink replenishing operation or the ink replenishing container 63.

(3-8) In the present embodiment, when the ink replenishing container 63 is coupled to the ink tanks 41 to 45 from a state where the ink replenishing container 63 is inclined along the radial direction where the two flow paths 54 and 55 are arranged from the direction where the needle 56 extends, of the two flow paths 54 and 55, one flow path on the side closer to the ink outlet 65 of the ink replenishing container 63 functions as the ink flow path, and the other flow path functions as the air flow path. Therefore, since the user may use any one of the two flow paths 54 and 55 as the ink flow path, the user can quickly perform the ink replenishing operation without choosing in doubt the flow path as the ink flow path.

(3-9) In the present embodiment, the projection portion 71 of the ink replenishing container 63 is fitted into the recessed portion 61 of the ink tanks 41 to 45, and the second uneven portion 72 on the outer surface of the projection portion 71 is engaged with the first uneven portion 62 on the inner surface of the recessed portion 61. Therefore, the user can recognize that the ink replenishing container 63 suitable for the ink tanks 41 to 45 is coupled. Therefore, the inadequate coupling between the ink tanks 41 to 45 and the ink replenishing container 63 can be suppressed. In addition, since the first uneven portion 62 is located at a position on the bottom surface side than the opening edge of the recessed portion 61 on the inner surface of the recessed portion 61 of the ink tanks 41 to 45, the projection portion 71 of the ink replenishing container 63 is easily guided from the opening side of the recessed portion 61 of the ink tanks 41 to 45 to the bottom surface side, and the insertion work can be easily performed.

(3-10) In the present embodiment, the second uneven portion 72 on the outer surface of the projection portion 71 in the ink replenishing container 63 can be engaged with the first uneven portion 62 provided on the inner surface of the recessed portion 61 of the ink tanks 41 to 45 so as to extend along the depth direction of the recessed portions 61, as the projection portion 71 is fitted into the recessed portion 61. As a result, the coupling direction of the ink outlet 65 of the ink replenishing container 63 to the ink inlet 53 of the ink tanks 41 to 45 can be easily recognized.

(3-11) In the present embodiment, since the depth direction of the recessed portion 61 provided on the outer side of the ink inlet 53 in the radial direction is vertically downward, in a state where the ink outlet 65 of the ink replenishing container 63 is coupled to the ink inlet 53 of each of the ink tanks 41 to 45, it is possible to prevent the ink from returning from the ink outlet 65 of the ink replenishing container 63 into the ink storage portion 76. As a result, the ink replenishing operation from the ink replenishing container 63 to the ink tanks 41 to 45 can be performed appropriately.

(3-12) In the present embodiment, in the ink replenishing container 63, when the projection portion 71 is fitted into any of the plurality of recessed portions 61 formed in point-symmetric about the ink inlet 53 in the ink tanks 41 to 45, the ink outlet 65 of the ink replenishing container 63 can be coupled to the ink inlets 53 of the ink tanks 41 to 45. Therefore, it is possible to easily perform the coupling work of the ink replenishing container 63 to the ink tanks 41 to 45 at the time of ink replenishment.

(3-13) In the present embodiment, the color colored in the peripheral portion of the ink inlet 53 of the ink replenishing adapter 47 in the ink tanks 41 to 45 functions as a first portion indicating information related to the ink stored in the ink storage chamber 49. The color colored in the container addition portion 67 of the ink replenishing container 63 functions as a second portion indicating information related to the ink stored in the ink storage portion 76. Therefore, when the ink replenishing container 63 is coupled to the ink tanks 41 to 45 and the ink is replenished, it can be easily determined whether or not the ink to be replenished is suitable by visually recognizing the first portion on the ink tanks 41 to 45 side and the second portion on the ink replenishing container 63 side.

(3-14) In the present embodiment, the projection portion 71 of the ink replenishing container 63 is formed on the inner side of the outer peripheral surface of the container main body portion 64 provided with the ink storage portion 76 in the radial direction with the ink outlet 65 as a center. Therefore, when the ink outlet 65 of the ink replenishing container 63 is coupled to the ink inlet 53 of the ink tanks 41 to 45, the projection portion 71 of the ink replenishing container 63 may not disturb for coupling the ink outlet 65 to the ink inlet 53.

(3-15) In the present embodiment, the ink replenishing adapter 47 is engaged with the plurality of ink tanks 41 to 45 on the lower surface 59 side in a state where the plurality of ink tanks 41 to 45 are integrated, and is provided with the plurality of first uneven portions 62 that can identify the ink replenishing container 63 having the ink outlet 65 which can be coupled to the ink inlet 53 for each of the ink tanks 41 to 45. Therefore, when the ink tanks 41 to 45 have a general-purpose common structure, and the lower surface 59 serving as the tank engagement portion of the ink replenishing adapter 47 is engaged in a state where the plurality of ink tanks 41 to 45 are integrated, a structure that can suppress erroneous mounting of the ink replenishing container 63 at the time of ink replenishment can be easily realized.

B. Second Embodiment

Figure 16:
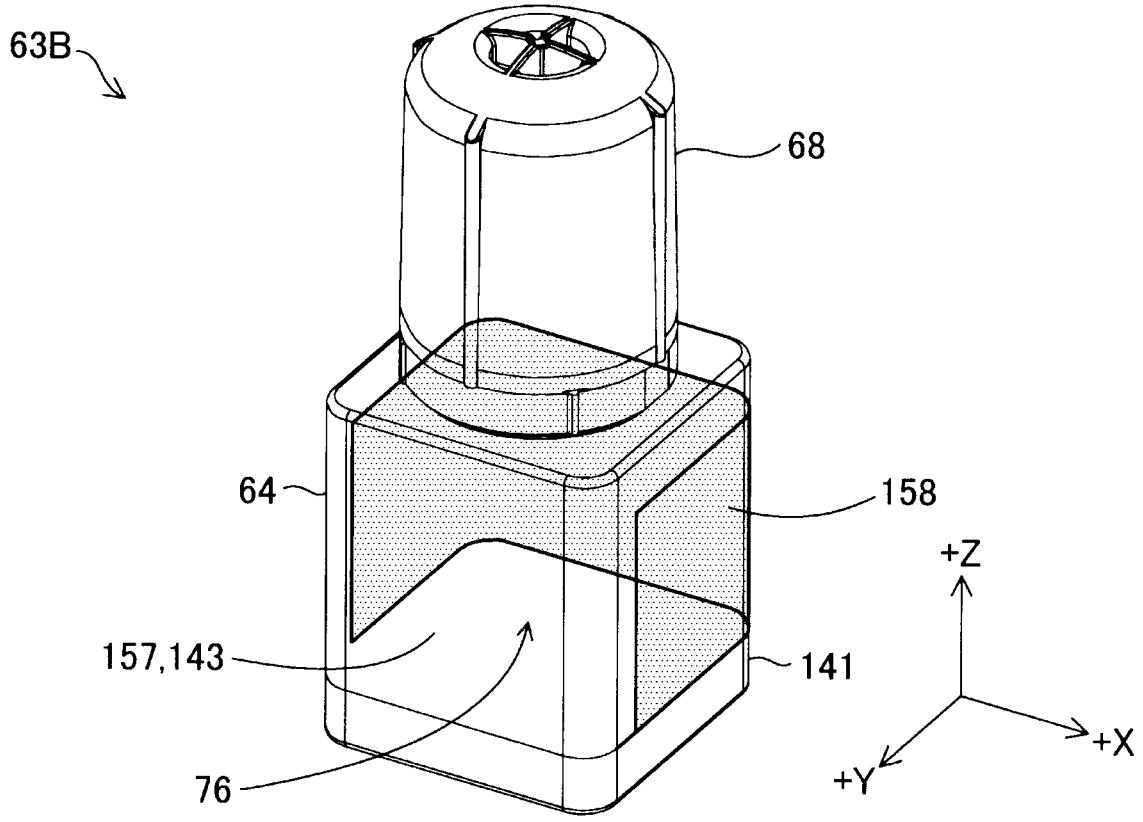
FIG. 16 is a perspective view schematically illustrating an ink replenishing container in a second embodiment.

FIG. 16 is a perspective view schematically illustrating an ink replenishing container 63B in a second embodiment. The ink replenishing container 63B of the present embodiment is provided with an ink visual recognition portion 157 in which the ink in the ink storage portion 76 is visually recognized on the surface located on the front surface side of the ink tanks 41 to 45, that is, on the surface on the +Y direction side, in a state where the projection portion 71 is fitted into the recessed portion 61 on the ink tanks 41 to 45 side.

In the present embodiment, the ink visual recognition portion 157 includes the container main body portion 64 made of a transparent or translucent material, and is configured by attaching a label 158 formed of paper, film, or the like to the outer wall 143 forming the surface other than the surface on the +Y direction side, that is, the surface on the −Y direction side, the surface on the +X direction side, and the surface on the −X direction side. In FIG. 16, the position where the label 158 is attached to the container main body portion 64 is illustrated with shading. The label 158 displays, for example, information related to the ink stored in the ink replenishing container 63. The ink visual recognition portion 157 may be provided with a mark or a scale serving as a measure of the amount of ink in the ink storage portion 76.

According to the ink replenishing container 63B of the second embodiment, when the ink is replenished from the ink replenishing container 63 to the ink tanks 41 to 45, a state where the ink in the ink storage portion 76 provided in the ink replenishing container 63 is reduced can be easily confirmed from the front surface side of the ink tanks 41 to 45. In particular, when the visual recognition portion 50 is also provided on the front surface side of the ink tanks 41 to 45 as in the recording apparatus 21 (refer to FIGS. 1 and 2) in the first embodiment, a state where the ink is reduced from the ink storage portion 76 of the ink replenishing container 63, and a state where the ink in the ink tanks 41 to 45 is increased can be simultaneously and visually recognized.

The ink visual recognition portion 157 may be provided on a portion of the surface of the container main body portion 64 on the +Y direction side, and the label 158 may be attached so as to cover a portion of the surface of the container main body portion 64 on the +Y direction side. In addition, as long as a portion or all of the label 158 attached to the surface on the +Y direction side is transparent, the label 158 may be provided on the entire surface on the +Y direction side. In addition, the ink visual recognition portion 157 may be configured to include, for example, only a portion corresponding to the ink visual recognition portion 157 of the container main body portion 64 made of transparent or translucent, and the other portion made of a non-transparent material. In addition, portions other than the portion corresponding to the ink visual recognition portion 157 of the container main body portion 64 may be colored.

C. Third Embodiment

Figure 17:
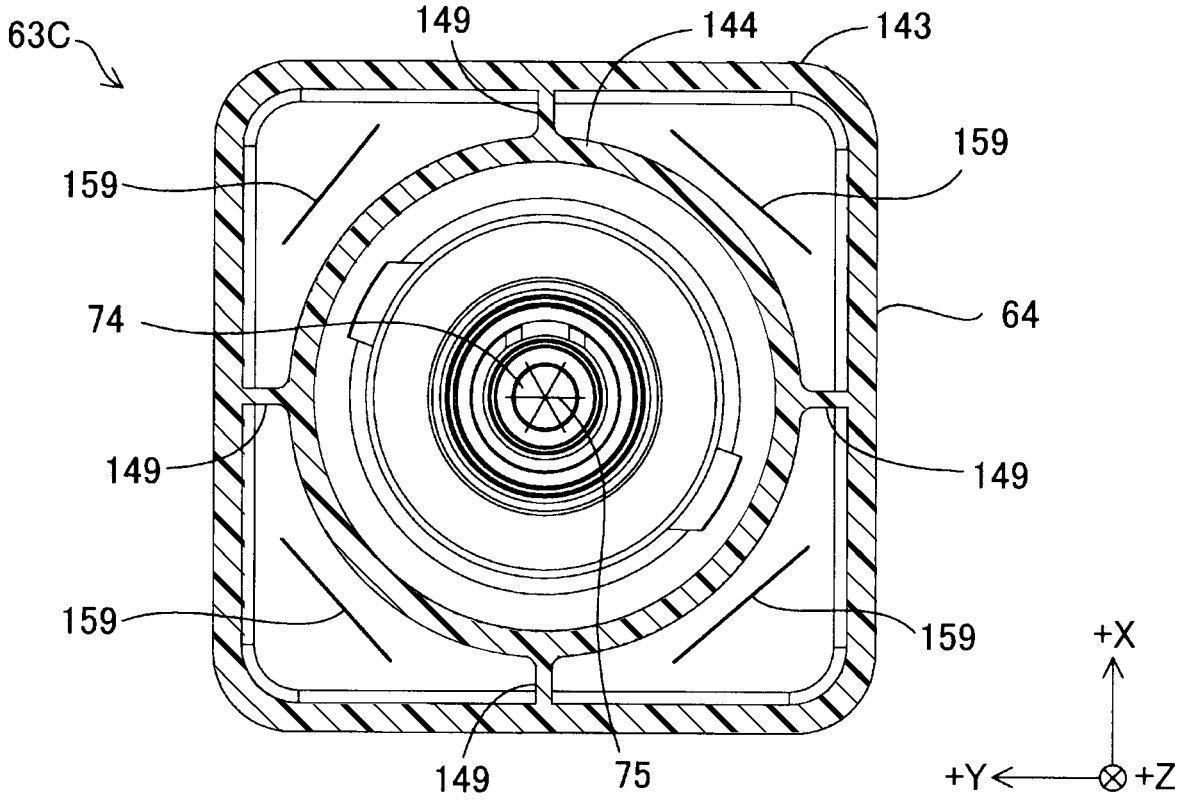
FIG. 17 is a cross-sectional view for describing an ink replenishing container according to a third embodiment.

FIG. 17 is a cross-sectional view for describing an ink replenishing container 63C according to a third embodiment. In FIG. 17, the cross section of the container main body portion 64 is illustrated. In the present embodiment, one information display member 159 is disposed in each of four spaces partitioned by the reinforcing rib 149, the inner wall 144, and the outer wall 143. Each information display member 159 displays, for example, information related to the ink stored in the ink replenishing container 63 and other various information. The information display member 159 is made of, for example, paper or film. The information display member 159 may be disposed without being fixed in the space, or may be attached to the front surface of the inner wall 144 or the rear surface of the outer wall 143 in the above space.

According to an ink replenishing container 63C of the third embodiment, various information displayed on the information display member 159 can be confirmed through the transparent or translucent outer wall 143. In addition, the space formed between the outer wall 143 and the inner wall 144 can be used efficiently.

In the present embodiment, the information display member 159 may not be disposed in all four spaces partitioned by the reinforcing rib 149, the inner wall 144, and the outer wall 143, or may be disposed in a portion of the space. In addition, when the reinforcing rib 149 is not formed on the container main body portion 64, the information display member 159 may be disposed between the inner wall 144 and the outer wall 143.

D. Fourth Embodiment

Figure 18:
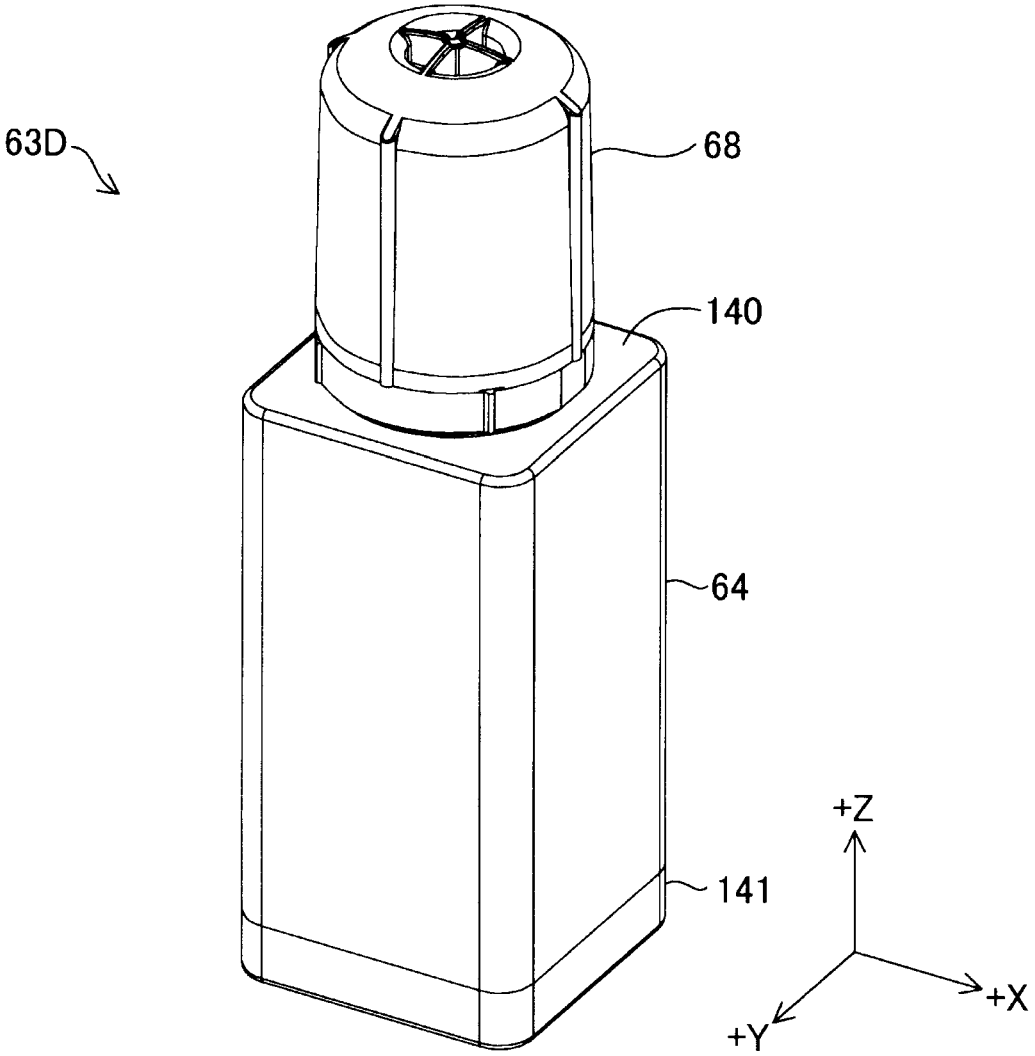
FIG. 18 is a perspective view of an ink replenishing container according to a fourth embodiment.

FIG. 18 is a perspective view of an ink replenishing container 63D according to a fourth embodiment. The ink replenishing container 63D of the fourth embodiment is larger in size in the up and down direction of the container main body portion 64 than the ink replenishing container 63 of the first embodiment. The shapes of the ink outlet 65, the ink outlet forming portion 66, and the container addition portion 67 are the same as those in the first embodiment. As described above, when the shapes of the ink outlet 65, the ink outlet forming portion 66, and the container addition portion 67 are unified, the size of the container main body portion 64 can be set to a predetermined size.

E. Other Embodiment (E-1) In the above embodiment, the ink replenishing container 63 may not be provided with the projection portion 71 or the container addition portion 67. In addition, the first bottom surface 147 is not limited to the film member 146, and may be formed of other members.

(E-2) In the above embodiment, the ink replenishing container 63 may not be provided with the cover 141. In addition, the cover 141 is not limited to the snap-fit structure, and may be fixed to the container main body portion 64 with an adhesive or a screw.

(E-3) In the above embodiment, the inner wall 144 is not limited to a cylindrical shape, and may be formed of a tubular shape having a polygonal cross section, for example. In addition, for example, the cross section of the inner wall 144 may be formed of a polygonal shape, and the outer wall 143 may be formed of a cylindrical shape.

(E-4) In the above embodiment, the container main body portion 64 may not be provided with the outer wall 143, and the side surface may be formed only of the inner wall 144. In addition, the container main body portion 64 may be provided with other side walls, in addition to the inner wall 144 and the outer wall 143.

(E-5) In the above embodiment, the protrusion 142 may not be provided on the lower surface of the cover 141.

(E-6) In the above embodiment, the reinforcing rib 149 is not limited to the shape along the vertical direction, and may be inclined so as to intersect the vertical direction, or may have a shape along the horizontal direction. In addition, the container main body portion 64 may not be provided with the reinforcing rib 149.

(E-7) In the above embodiment, each of the recessed portions 61 into which the projection 71 of the ink replenishing container 63 is fitted is provided in the ink replenishing adapter 47. On the other hand, each of the recessed portions 61 may be provided directly in the ink tanks 41 to 45.

(E-8) In the above embodiment, each of the recessed portions 61 into which the projection 71 of the ink replenishing container 63 is fitted is provided in the ink replenishing adapter 47. On the other hand, each of the recessed portions 61 may be provided corresponding to each of the ink tanks 41 to 45, and may be provided at a location separated from each of the ink tanks 41 to 45. The separated location may be another location in the recording apparatus 21 or another location separated from the recording apparatus 21. In this case, each of the recessed portions 61 and each of the ink tanks 41 to 45 are coupled to each other by a flow path member such as a tube so that the ink can flow.

(E-9) In the above embodiment, the ink supply unit 40 includes the plurality of ink tanks 41 to 45. On the other hand, the ink supply unit 40 may be configured as one tank including a plurality of ink storage chambers 49. That is, the ink supply unit 40 may be provided with a wall that partitions each of the ink storage chambers 49 inside.

(E-10) In the above embodiment, the ink replenishing container 63 is provided with the valve 74 in which the slit 75 is formed. However, the valve 74 is not limited to such a slit valve structure. For example, the valve 74 may be provided with a valve body and an elastic member such as a spring, and may be configured to bias the valve body to a valve seat provided on the ink outlet 65 side by the elastic member. In this case, when the needle 56 is inserted into the ink outlet 65, the valve body is pushed up by the needle 56, and the ink flows from the ink storage portion 76 toward the needle 56. In addition, for example, the ink replenishing container 63 may not be provided with the valve 74, and the film member may be provided in the ink outlet 65. In this case, when the needle 56 is inserted into the ink outlet 65, the film member is broken, and the ink flows from the ink storage portion 76 toward the needle 56.

(E-11) In the above embodiment, the first portion provided for each of the ink tanks 41 to 45 as indicating information related to the ink stored in the ink tanks 41 to 45, and the second portion provided for each of the ink replenishing containers 63 as indicating information related to the ink stored in the ink replenishing container 63 may be character information, shape information, or the like, in addition to the coloring information. In addition, the configuration related to the first portion and second portion may not be provided.

(E-12) In the above embodiment, the outer wall 143 or the inner wall 144 of the container main body portion 64 may be provided with a scale for measuring the amount of ink in the ink storage portion 76.

(E-13) The present disclosure can be applied not only to a printer and an ink replenishing container thereof, but also to any liquid ejecting apparatus that consumes a liquid other than an ink and a container used in these liquid ejecting apparatuses. For example, this disclosure can be applicable as a container used for the following various liquid ejecting apparatuses.

(1) An image recording apparatus such as a facsimile apparatus.

(2) A color material ejecting apparatus used for manufacturing a color filter for an image display apparatus such as a liquid crystal display.

(3) An electrode material ejecting apparatus used for electrode formation such as an organic electro luminescence (EL) display and a field emission display (FED).

(4) A liquid ejecting apparatus that ejects a liquid containing a bio-organic material used for biochip manufacture.

(5) A sample ejecting apparatus as a precision pipette.

(6) A lubricating oil ejecting apparatus.

(7) A resin liquid ejecting apparatus.

(8) A liquid ejecting apparatus that ejects lubricating oil to precision machines such as a timepiece and a camera with a pinpoint.

(9) A liquid ejecting apparatus that ejects a transparent resin liquid such as an ultraviolet curable resin liquid onto a substrate to form a micro hemispherical lens (optical lens) used for an optical communication element or the like.

(10) A liquid ejecting apparatus that ejects an acidic or alkaline etching solution to etch a substrate or the like.

(11) A liquid ejecting apparatus provided with a liquid consuming head that ejects another predetermined minute amount of liquid droplets.

"Droplet" refers to a state of the liquid ejected from the liquid ejecting apparatus, and includes those that have tails in the form of particles, tears, and threads. In addition, the "liquid" here may be any material that can be consumed by the liquid ejecting apparatus. For example, the "liquid" may be a material in a state where the substance is in a liquid phase, and liquid materials with high or low viscosity and liquid materials such as sol, gel water, other inorganic solvents, organic solvents, solutions, liquid resins, and liquid metal (metal melt) are also included in the "liquid". In addition, "liquid" includes not only a liquid as one state of a substance but also a liquid obtained by dissolving, dispersing or mixing particles of a functional material made of a solid such as a pigment or metal particles in a solvent. In addition, representative examples of the liquid include ink and liquid crystal as described in the above embodiment. Here, the ink includes various liquid compositions such as a normal water-based ink and an oil-based ink, a gel ink, and a hot-melt ink.

F. Other Aspect

The present disclosure is not limited to the above-described embodiment, and can be realized with various configurations without departing from the spirit of the present disclosure. For example, the technical features of the embodiments corresponding to the technical features in each embodiment described below can be appropriately replaced or combined to solve some or all of the above-described problems, or to achieve some or all of the above effects. In addition, when the technical feature is not described as essential in the present specification, it can be deleted as appropriate.

(1) According to an aspect of the present disclosure, there is provided an ink replenishing container. The ink replenishing container is provided with a first bottom surface that defines a portion of an ink storage portion in which an ink is stored, a first side wall that intersects the first bottom surface and defines a portion of the ink storage portion, an ink outlet that communicates with the ink storage portion, and a second side wall that is disposed outside the first side wall, and that is not in contact with the ink stored in the ink storage portion.

According to the ink replenishing container with such an aspect, since the second side wall is disposed outside the first side wall that defines the ink storage portion, it is possible to prevent the volume of the ink storage portion from being changed even when the side surface is strongly pressed by the user. Therefore, it is possible to reduce the possibility that the ink ejects vigorously from the ink outlet to stain the surroundings. In addition, since the second side wall is disposed outside the first side wall that defines the ink storage portion, it is possible to prevent the ink storage portion from being damaged when the ink replenishing container drops from the side surface. Therefore, the ink can be prevented from leaking due to dropping or the like.

(2) The ink replenishing container according to the above aspect may be provided with a second bottom surface that intersects the second side wall, that is disposed below the first bottom surface, and that is not in contact with the ink stored in the ink storage portion. With such an aspect, it is possible to more effectively prevent the ink storage portion from being damaged due to dropping or the like.

(3) In the ink replenishing container according to the above aspect, a distance in the horizontal direction, between the first side wall and the second side wall may not be constant. With such an aspect, the design of the ink replenishing container and the degree of freedom of design increase.

(4) In the ink replenishing container according to the above aspect, a cross-sectional shape of the first side wall may be a circle, and a cross-sectional shape of the second side wall may be a polygon. With such an aspect, the pressure resistance of the ink storage portion is improved, and furthermore, the possibility that the ink replenishing container rolls and drops from a high place and is damaged can be reduced.

(5) The ink replenishing container according to the above aspect may be provided with a reinforcing rib that couples the first side wall and the second side wall. With such an aspect, since the rigidity of the ink replenishing container can be increased, it is possible to more effectively prevent the volume of the ink storage portion from being changed and the ink from ejecting when the side surface is strongly pressed by the user.

(6) The ink replenishing container according to the above aspect may be provided with an information display member disposed between the first side wall and the second side wall. With such an aspect, the space formed between the first side wall and the second side wall can be used efficiently.

(7) In the ink replenishing container according to the above aspect, the ink outlet may include a slit valve. With such an aspect, the ink can be replenished to the ink tank or the like from the ink outlet with a simple configuration.

(8) The ink replenishing container according to the above aspect may include a projection portion that fits into a recessed portion provided corresponding to an ink tank to which the ink is replenished at least at a portion of a periphery of the ink outlet. With such an aspect, the ink replenishing container can be stably coupled to the ink tank.

(9) The ink replenishing container according to the above aspect may be provided with an ink visual recognition portion in which the ink in the ink storage portion is visually recognized on a surface located on a front surface side of the ink tank in a state where the projection portion is fitted into the recessed portion. With such an aspect, it is possible to easily confirm the state of the ink in the ink storage portion at the time of ink replenishment.

(10) According to another aspect of the present disclosure, there is provided an ink replenishing system. The ink replenishing system is provided with the ink replenishing container according to any one of the aspects described above, and an ink tank that includes an ink inlet to which the ink is replenished from the ink outlet. The ink replenishing system with such an aspect also has the same effect as the ink replenishing container with the above aspect.

The present disclosure is not limited to the above-described aspects as the ink replenishing container or the ink tank, and can be realized as various aspects such as a system provided with an ink replenishing container and a printer, and an ink replenishing method.

What is claimed is:

1. An ink replenishing container comprising:

a first bottom surface that defines a portion of an ink storage portion in which an ink is stored;

a first side wall that intersects the first bottom surface and defines a portion of the ink storage portion;

an ink outlet that communicates with the ink storage portion; and a second side wall that is disposed outside the first side wall, and that is not in contact with the ink stored in the ink storage portion, wherein a cross-sectional shape of the first side wall is a circle, and a cross-sectional shape of the second side wall is a polygon, and the first bottom surface has a shape corresponding to the cross-sectional shape of the first side wall.

2. The ink replenishing container according to claim 1, further comprising:

a second bottom surface that intersects the second side wall, that is disposed below the first bottom surface, and is not in contact with the ink stored in the ink storage portion.

3. The ink replenishing container according to claim 1, wherein a distance in the horizontal direction, between the first side wall and the second side wall is not constant.

4. The ink replenishing container according to claim 1, further comprising:

a reinforcing rib that couples the first side wall and the second side wall.

5. The ink replenishing container according to claim 1, further comprising:

an information display member disposed between the first side wall and the second side wall.

6. The ink replenishing container according to claim 1, wherein the ink outlet includes a slit valve.

7. The ink replenishing container according to claim 1, further comprising:

a projection portion that fits into a recessed portion provided corresponding to an ink tank to which the ink is replenished, at least at a portion of a periphery of the ink outlet.

8. The ink replenishing container according to claim 7, further comprising:

an ink visual recognition portion in which the ink in the ink storage portion is visually recognized on a surface located on a front surface side of the ink tank in a state where the projection portion is fitted into the recessed portion.

9. An ink replenishing system comprising:

the ink replenishing container according to claim 1; and an ink tank that includes an ink inlet to which the ink is replenished from the ink outlet.

* * * * *